US007217203B2

(12) United States Patent
Takeuchi et al.

(10) Patent No.: US 7,217,203 B2
(45) Date of Patent: May 15, 2007

(54) TENNIS RACKET

(75) Inventors: Hiroyuki Takeuchi, Hyogo (JP); Takeshi Ashino, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/967,296

(22) Filed: Oct. 19, 2004

(65) Prior Publication Data

US 2005/0192128 A1 Sep. 1, 2005

(30) Foreign Application Priority Data

Feb. 27, 2004 (JP) ..... 2004-055463

(51) Int. Cl.
*A63B 49/02* (2006.01)

(52) U.S. Cl. ..... 473/537; 473/521; 473/539

(58) Field of Classification Search ..... 473/520–522, 473/524, 537, 539
See application file for complete search history.

(56) References Cited

U.S. PATENT DOCUMENTS 5,165,687 A * 11/1992 Soong ..... 473/521
5,368,297 A * 11/1994 Liu ..... 473/539
6,293,878 B1 * 9/2001 Iwatsubo et al. ..... 473/521
6,530,851 B2 * 3/2003 Munster ..... 473/521
2002/0058557 A1 * 5/2002 Kanemitsu ..... 473/520
2005/0192128 A1 * 9/2005 Takeuchi et al. ..... 473/520

FOREIGN PATENT DOCUMENTS

JP 2000-300698 A 10/2000
JP 2003-175134 A 6/2003

* cited by examiner

*Primary Examiner*—Raleigh W. Chiu
(74) *Attorney, Agent, or Firm*—Birch, Stewart, Kolasch and Birch, LLP

(57) ABSTRACT

A tennis racket having a racket frame defining a ball-hitting face, wherein if the upper part of the ball-hitting face is set as a 0-degree position, a string protection member is mounted on at least one portion of a head part of the racket frame in a range from a clockwise 45-degree position to a clockwise 135-degree position and in a range from a clockwise 225-degree position to a clockwise 315-degree position by interposing a viscoelastic member between the string protection member and the racket frame. The moment (Is) of inertia of the tennis racket in a swing direction is set to not less than 450,000 g/cm$^2$ nor more than 490,000 g/cm$^2$, when strings are not tensionally mounted thereon. The moment (Ic) of inertia of the tennis racket in a center direction is set to not less than 15,000 g/cm$^2$ nor more than 19,000 g/cm$^2$, when the strings are not tensionally mounted thereon.

18 Claims, 19 Drawing Sheets

( ⟶ hit with impact hammer )

PRIOR ART

TENNIS RACKET

This Nonprovisional application claims priority under 35 U.S.C. § 119(a) on Patent Application No(s). 2004-055463 filed in Japan on Feb. 27, 2004, the entire contents of which are hereby incorporated by reference.

BACKGROUND OF THE INVENTION

The present invention relates to a tennis racket. More particularly, the present invention relates to a lightweight tennis racket for regulation-ball tennis having improved restitution performance, ball controllability, and vibration-damping performance.

The so-called "thick racket" which is thick in the out-of-plane direction of the racket frame is commercially available. Female and senior tennis players require the "thick racket" because they desire the tennis racket to have highs ball rebound performance, even though they hit the ball with a small amount of power. That is, they demand a tennis racket that is light in weight and has a high, ball rebound performance. Therefore a fiber reinforced resin is mainly used as the material for the tennis racket because the fiber reinforced resin has a light weight, has a high specific strength, and provides a high degree of freedom when designing the tennis racket.

However, the light weight tennis racket has a the problem that in the collision between the tennis racket and the ball, the coefficient of restitution of the ball becomes low according to the law of energy conservation. That is, to make the tennis racket lightweight causes the rebound performance to deteriorate. To solve this problem, it is possible to enhance the moment of inertia of the tennis racket in the swing direction by placing the center of gravity thereof at a position a little closer to the top of the racket frame. However, when the moment of inertia of the tennis racket in the swing direction is large, the player feels that the tennis racket is heavy and thus its operability deteriorates.

The light weight tennis racket causes the impact applied thereto when the ball is hit to be readily transmitted to a player's hand, which causes the player to suffer from tennis elbow. Thus, both female and senior tennis players who participate in competitions requires a tennis racket which has a high face stability and excellent controllability and is light weight.

To solve these problems, the present applicant proposed a tennis racket disclosed in Japanese Patent Application Laid-Open No. 2003-175134 (patent document 1). The present applicant developed a tennis racket whose rebound performance, operability, and face stability are improved in a favorable balance by enhancing the rigidity of the racket frame and setting the ratio between the swing-direction moment of inertia affecting the rebound performance thereof and the center-direction moment of inertia affecting the face stability thereof to a predetermined range.

However, in the tennis racket shown in patent document 1, attention was not paid to an improvement of its vibration-absorbing performance.

In Japanese Patent Application Laid-Open No. 2000-300698 (patent document 2), as shown in FIG. 19, the string protection member 2 is constructed of a vibration-damping member 3 in which the cylindrical portion 3*a* through which strings are inserted and the belt-shaped portion 3*b* connected with the cylindrical portion 3*a*; and the belt-shaped protection member 4 covering the periphery of the belt-shaped portion 3*b* of the vibration-damping member 3. The weight member 5, made of a material having a specific gravity of not less than 1.5 and the vibration-damping member 3 are mounted on the racket frame 1 by holding down the weight member 5 and the vibration-damping member 3 with the protection member 4. Accordingly, the tennis racket exhibits improved rebound performance, face stability, and vibration-absorbing performance.

However, the tennis racket shown in patent document 2 is not constructed to increase the deformation amount of the string protection member 2. Thus the rebound performance of the racket frame cannot be effectively improved, and its ball-flying performance cannot be enhanced. Another problem with this tennis racket is that the number of component parts increases which makes it difficult to achieve a light weight. Thereby the operability of the tennis racket may deteriorate.

In addition to the means disclosed in the above patent documents, the following rebound performance-improving means are conceivable:

(1) The area of the face of the racket frame is increased to widen the string-movable range.

(2) The in-plane rigidity of the frame is increased.

(3) The elasticity of the frame is made high.

However, means (1) has the problem that because the area of the face is increased, the weight and the moment of inertia of the tennis racket is increased and hence its operability deteriorates. Means (2) has the problem that the moldability deteriorates due to the alteration of the sectional configuration of the frame caused by the formation of a layered construction or a reinforcing portion. Means (3) has a the problem that the strength of the frame deteriorates.

Patent document 1: Japanese Patent Application Laid-Open No. 2003-175134

Patent document 2: Japanese Patent Application Laid-Open No. 2000-300698

SUMMARY OF THE INVENTION

The present invention has been made in view the above-described problem. Therefore, it is an object of the present invention to provide a tennis racket that has a high vibration-damping performance and a high rebound performance without making the tennis racket heavy, and has a high degree of controllability due to an improvement in face stability.

To achieve this object, there is provided a tennis racket including a racket frame having a weight not less than 100 g nor more than 270 g. A string protection member is provided on at least one portion of a peripheral surface of a head part surrounding the ball-hitting face of the racket frame. The string protection member has a plurality of cylindrical portions through which strings are respectively inserted and a belt-shaped portion. Supposing that a midpoint of a maximum length of the ball-hitting face of the racket frame is set as a center thereof and that an intersection of a longest line of the ball-hitting face and an upper part of the ball-hitting face is set as a 0-degree position, the string protection member is mounted on at least one portion of the head part in a range from a clockwise 45-degree position to a clockwise 135-degree position and in a range from a clockwise 225-degree position to a clockwise 315-degree position by interposing the viscoelastic member between the string protection member and the racket frame. A moment (Is) of inertia of the tennis racket in a swing direction is set to not less than 450,000 g/cm$^2$ nor more than 490,000 g/cm$^2$, when the strings are not tensionally mounted thereon. A moment (Ic) of inertia of the tennis racket in a center direction is set to not less than 15,000 g/cm$^2$ nor more than 19,000 g/cm$^2$, when the strings are not tensionally mounted thereon.

As described above, by mounting the viscoelastic member on at least one portion of the head part in the range from the 45-degree position to the 135-degree position and in the range from the 225-degree position to the 315-degree position, it is possible to enhance the moment of inertia in the swing direction and the center direction in a favorable balance, making it possible to improve the rebound performance and controllability of the tennis racket.

That is, when the string protection member is mounted on the above-described range, the weight thereof is applied to the outer side of the tennis racket with respect to its axis passing through the axis of the grip part. Therefore the moment of inertia in the center direction increases and the tennis racket has difficulty in its rotation on its axis. Thereby the tennis racket has face stability. However, when the string protection member is mounted on the top side of the racket frame disposed upward from the 45-degree position and the 315-degree position, the center of gravity of the tennis racket is disposed a little nearer to the top position of the racket from its center. Consequently the moment of inertia of the tennis racket in the swing direction is large, whereas the moment of inertia thereof in the center direction is not large. Thus the rebound performance of the racket frame is enhanced but its operability and face stability deteriorate. When the string protection member is mounted on the lower side of the racket frame disposed downward from the 135-degree position and the 225-degree position, neither the moment of inertia of the tennis racket in the center direction, nor the moment of inertia thereof in the swing direction is large. Thus neither the rebound performance of the racket frame nor its face stability is improved.

It is necessary to mount the string protection member on at least one portion of the above-described angular range and possible to extend the mounting-range of the string protection member from the above-described angular range.

It is favorable to mount at least one portion of the string protection member on the head part in the range from a 60-degree position to a 120-degree position and the range from a 240-degree position to a 300-degree position and more favorable to mount at least one portion of the string protection member on the head part in the range from a 75-degree position to a 105-degree position and the range from a 255-degree position to a 285-degree position. It is particularly favorable to mount one string protection member on the head part with the center of the string protection member disposed at a 90-degree position and a 270-degree position. The line connecting the 90-degree position and the 270-degree position with each other forms the longest width of the racket frame. This is because the above-described ranges increase the moment of inertia in the swing direction and the center direction in a favorable balance. Thereby it is possible to realize a high rebound performance, face stability, and operability.

The string protection member is mounted favorably in only the range from a 35-degree position to a 145-degree position and the range from a 215-degree position to a 325-degree position, more favorably in only the range from a 50-degree position to a 130-degree position and the range from a 230-degree position to a 310-degree position, and most favorably in only the range from a 65-degree position to a 115-degree position and the range from a 245-degree position to a 295-degree position. This is because if the string protection member is mounted in a range other than the above-described angular range, the tennis racket is heavy and its operability is low.

The angular difference between a start angular position of the string protection member and a termination angular position thereof is set to not less than 10 degrees, favorably not less than 15 degrees, and more favorably not less than 20 degrees. The angular difference between the start angular position of the string protection member and the termination angular position thereof is set to not more than 60 degrees, favorably not more than 40 degrees, more favorably not more than 30 degrees, and most favorably not more than 20 degrees.

The reason the angular difference between the start angular position of the string protection member and the termination angular position thereof is set to less than 10 degrees nor more than 60 degrees is as follows: If the mounting range of the string protection member is too long, the tennis racket is so heavy that its operability is low. If the mounting range of the string protection member is too short, the effect of enhancing the rebound performance of the racket frame and its face stability is insufficient.

The reason the moment Is of the inertia of the tennis racket in the swing direction when the strings are not tensionally mounted on the racket frame is set to not less than 450,000 g/cm$^2$ nor more than 490,000 g/cm$^2$ is as follows: If the moment of inertia of the tennis racket in the swing direction is less than 450,000 g/cm$^2$, the tennis racket has a favorable operability but has a low rebound performance. If the moment of inertia of the tennis racket in the swing direction is more than 490,000 g/cm$^2$, the tennis racket has an unfavorable operability. The moment of inertia of the tennis racket in the swing direction is set to favorably not less than 455,000 g/cm$^2$, more favorably not less than 456,000 g/cm$^2$, and most favorably not less than 460,000 g/cm$^2$. The moment of inertia of the tennis racket in the swing direction is set to favorably not more than 480,000 g/cm$^2$, more favorably not more than 476,000 g/cm$^2$, and most favorably not more than 470,000 g/cm$^2$.

The reason the moment Ic of the inertia of the tennis racket in the center direction when the strings are not tensionally mounted on the racket frame is set to not less than 15,000 g/cm$^2$ nor more than 19,000 g/cm$^2$ is as follows: If the moment of inertia of the tennis racket in the center direction is set to less than 15,000 g/cm$^2$, the tennis racket has an unfavorable face stability. If the moment of inertia of the tennis racket in the center direction is more than 19,000 g/cm$^2$, the tennis racket has a large ball-hitting face or heavy. Thus the tennis racket has an unfavorable operability. The moment of inertia of the tennis racket in the center direction is set to favorably not less than 16,000 g/cm$^2$, more favorably not less than 16,300 g/cm$^2$, and most favorably not less than 16,400 g/cm$^2$. The moment of inertia of the tennis racket in the center direction is set to favorably not more than 18,000 g/cm$^2$, more favorably not more than 17,900 g/cm$^2$, and most favorably not more than 17,300 g/cm$^2$.

By interposing the viscoelastic member between the frame and the string protection member, the viscoelastic member restrains vibrations of strings from being transmitted to the frame, even though the racket frame has a high strength and elasticity, thereby effectively damping the vibrations of the frame.

As the viscoelastic member, rubber, elastomer, and resin having a low elastic modulus are preferable. Rubber only or rubber mixed with carbon black is particularly preferable.

The viscoelastic member has a hole through which a cylindrical portion of the string protection member is penetrated, is interposed between a belt-shaped portion of the string protection member and a peripheral surface of the head part of the racket frame; and is plate-shaped. Since the viscoelastic member has the above-described configuration, it is possible to mount the viscoelastic member on the peripheral surface of the head part in a certain length and reliably fix the viscoelastic member between the string protection member and the frame.

The thickness of the viscoelastic member is not less than 1 mm nor more than 5 mm. The complex elastic modulus of the viscoelastic member measured at a frequency of 10 Hz is not less than 2.0E+7 dyn/cm$^2$ nor more than 1.0E+10 dyn/cm$^2$ at temperatures in the range of 0° C. to 10° C.

If the thickness of the viscoelastic member is less than 1 mm, it is impossible to sufficiently improve the rebound performance and vibration-absorbing performance of the racket frame. If the thickness of the viscoelastic member is more than 5 mm, the weight of the racket frame increases and hence its operability deteriorates. If the complex elastic modulus of the viscoelastic member is less than 2.0E+7 dyn/cm$^2$, concentration of a stress on the frame is generated and hence the frame is liable to be broken. If the complex elastic modulus of the viscoelastic member is more than 2.0E+7 dyn/cm$^2$, the string is deformed to a low extent by a load applied thereto when a ball is hit. Consequently the viscoelastic member is incapable of obtaining a sufficient spring effect. Further the rebound performance of the racket frame cannot be improved and a non-resonance occurs. Thus the viscoelastic member does not function as a vibration damper. The complex elastic modulus of the viscoelastic member is favorably not less than 1.0E+8 dyn/cm$^2$, and more favorably not less than 3.86E+8 dyn/cm$^2$ nor more than 2.72E+9 dyn/cm$^2$.

In the above-described construction, because the viscoelastic member is mainly functioned as the vibration-damping member, the string protection member is not demanded to have a high vibration-damping function. Thus it is unnecessary to form the string protection member from a soft material. Thereby the cylindrical portion which contacts the strings and the string protection member having the cylindrical portion are capable of having have rigidity to some extent. Therefore it is possible to hold down the viscoelastic member with the viscoelastic member being covered with the string protection member. Further it is possible to improve the durability of the string protection member and prevent the strings from biting into the string protection member. Thereby it is possible to prevent a stress from being collectively applied to the frame. Therefore it is possible to enhance the strength and durability of the racket frame.

The string protection member is required to have the durability securely. Thus Shore D hardness is set to favorably not less than 50 nor more than 80 and more favorably not less than 55 nor more than 75. More specifically, it is preferable that the string protection member is formed by molding thermoplastic resin such as nylon 11, nylon 12, polyether block amide, polyamide resin, and the like. Thereby the string protection member has vibration-absorbing performance to some extent and rigidity to some extent.

By interposing the viscoelastic member between the frame and the string protection member, the string protection member can be deformed by utilizing the deformability of the viscoelastic member. Consequently the spring effect can be obtained. Thereby the ball rebound performance can be enhanced.

The viscoelastic member is lightweight and is capable of performing its function only by mounting it on a predetermined portion of the peripheral surface of the frame. Therefore the viscoelastic member is capable of complying with the demand for making the tennis racket lightweight.

It is preferable that a bumper made of fiber reinforced resin is interposed between the string protection member and the viscoelastic member. In this construction, since the bumper made of the fiber reinforced resin is rigid, the spring effect of the viscoelastic member can be displayed sufficiently, which is preferable.

The width of the belt-shaped portion of the string protection member is enlarged so that the string protection member has a configuration of covering both outer surfaces of the head part between which a string groove thereof is interposed. The string protection member is mounted on the head part by interposing the viscoelastic member between the belt-shaped portion the string protection member and the head part, with the viscoelastic member covering an entire lower surface of the belt-shaped portion.

As apparent from the foregoing description, the moment (Is) of inertia of the tennis racket in the swing direction is set to not less than 450,000 g/cm$^2$ nor more than 490,000 g/cm$^2$, when the strings are not tensionally mounted thereon. The moment (Ic) of inertia of the tennis racket in the center direction is set to not less than 15,000 g/cm$^2$ nor more than 19,000 g/cm$^2$, when the strings are not tensionally mounted thereon. Therefore it is possible to enhance the moment of inertia in the swing direction affecting the rebound performance of the tennis racket and that in the center direction affecting the face stability in a favorable balance. Thereby the tennis racket of the present invention is capable of maintaining preferable operability and having improved ball rebound performance and controllability.

When the strings are tensionally mounted on the ball-hitting face with the strings in penetration through the string protection member, the viscoelastic member interposed between the string protection member and the frame absorbs vibrations of the strings generated when a ball is hit, thereby suppressing vibrations of the frame. Further the string protection member is capable of obtaining the spring effect by utilizing the deformability of the viscoelastic member. Thereby the ball rebound performance of the racket frame can be also enhanced in this respect.

DETAILED DESCRIPTION OF THE PREFERRED EMBODIMENTS

Figure 1:
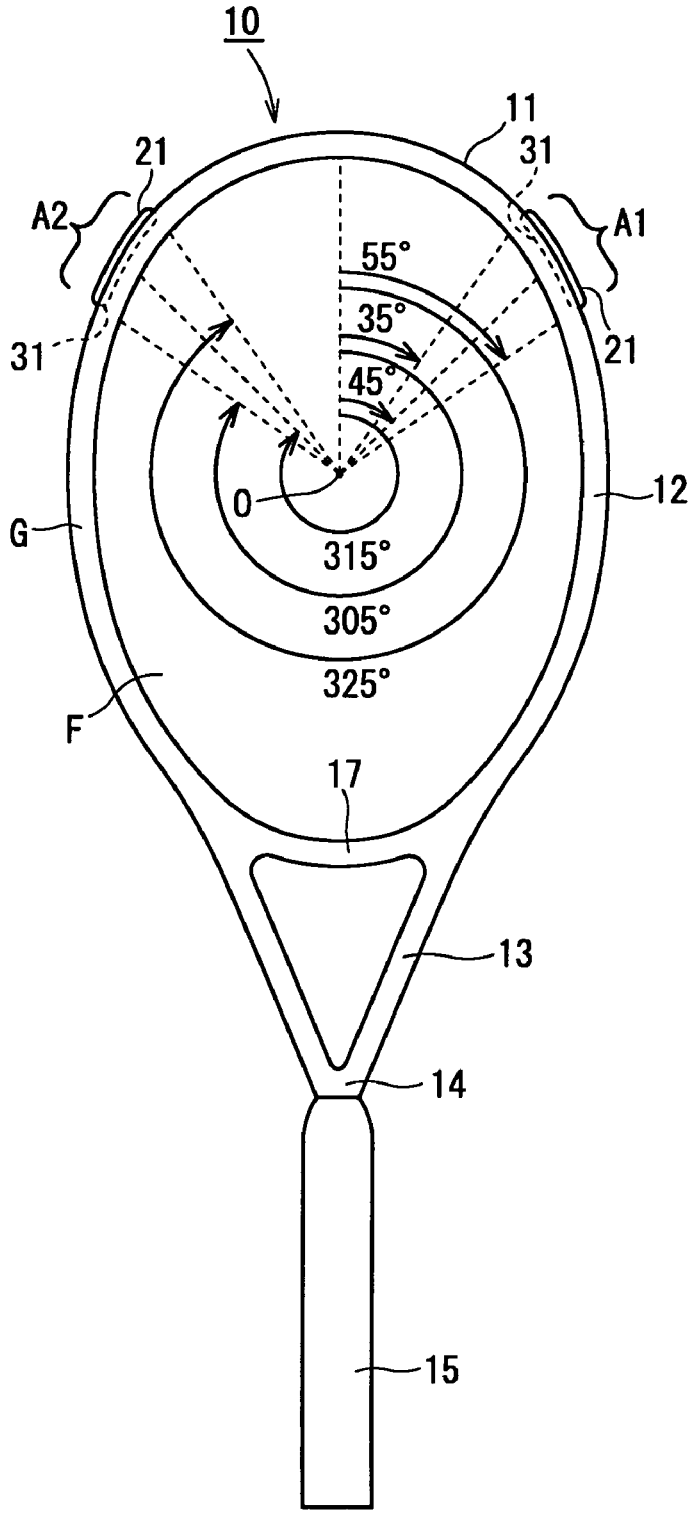
FIG. 1 is a front view showing a tennis racket of a first embodiment of the present invention.

The embodiments of the present invention will be described below with reference to the drawings. The embodiments which will be described below are suitable for a racket frame for regulation-ball tennis.

FIGS. 1 through 4 show a first embodiment of the present invention. In a tennis racket 10, one string protection member 21 is mounted at two portions on the peripheral side of a head part 12 surrounding a ball-hitting face F. Strings S are mounted on the racket frame, with a viscoelastic member 31 interposed between the string protection member 21 and the racket frame 11, as shown in FIG. 3B.

Figure 2:
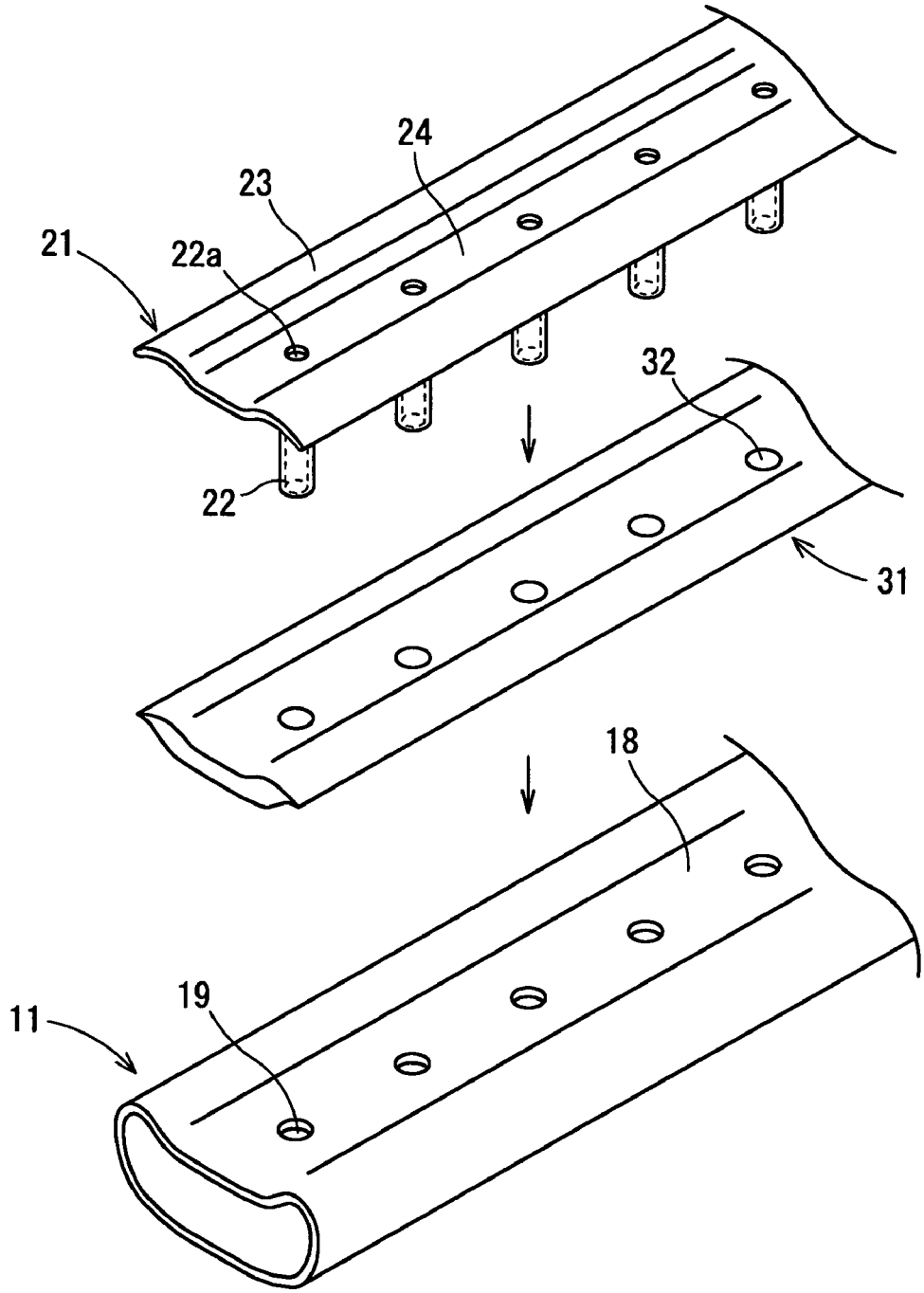
FIG. 2 is an exploded perspective view showing main parts of the tennis racket shown in FIG. 1.
Figure 3A:
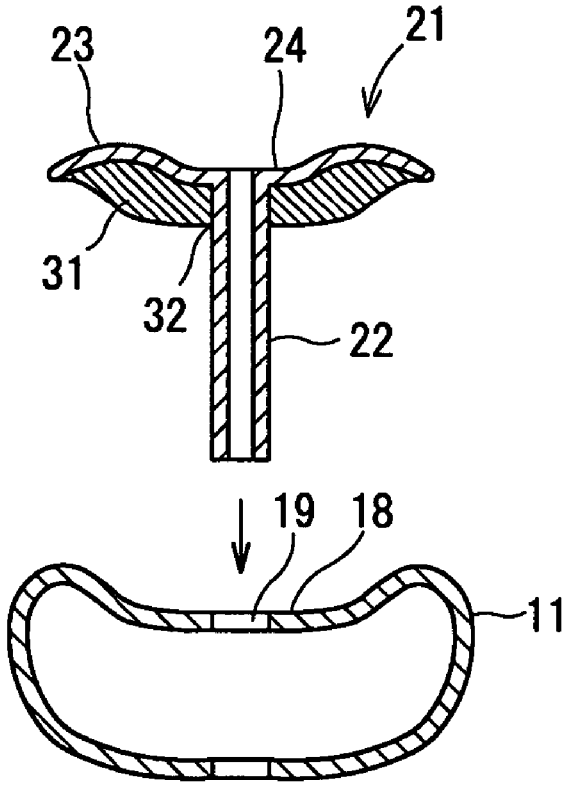
FIGS. 3A and 3B are sectional views showing the procedure of mounting a string protection member and a viscoelastic member on the frame of the tennis racket shown in FIG. 1.
Figure 3B:
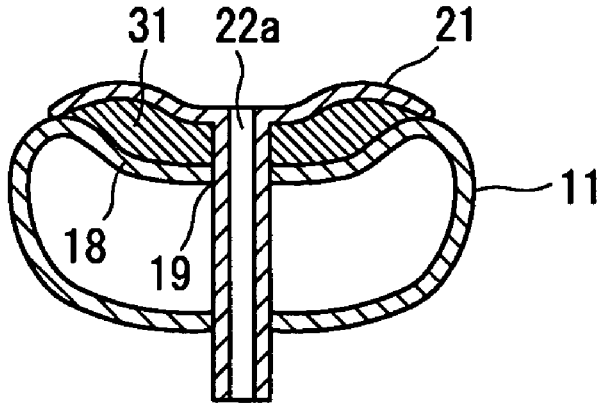
Figure 4:
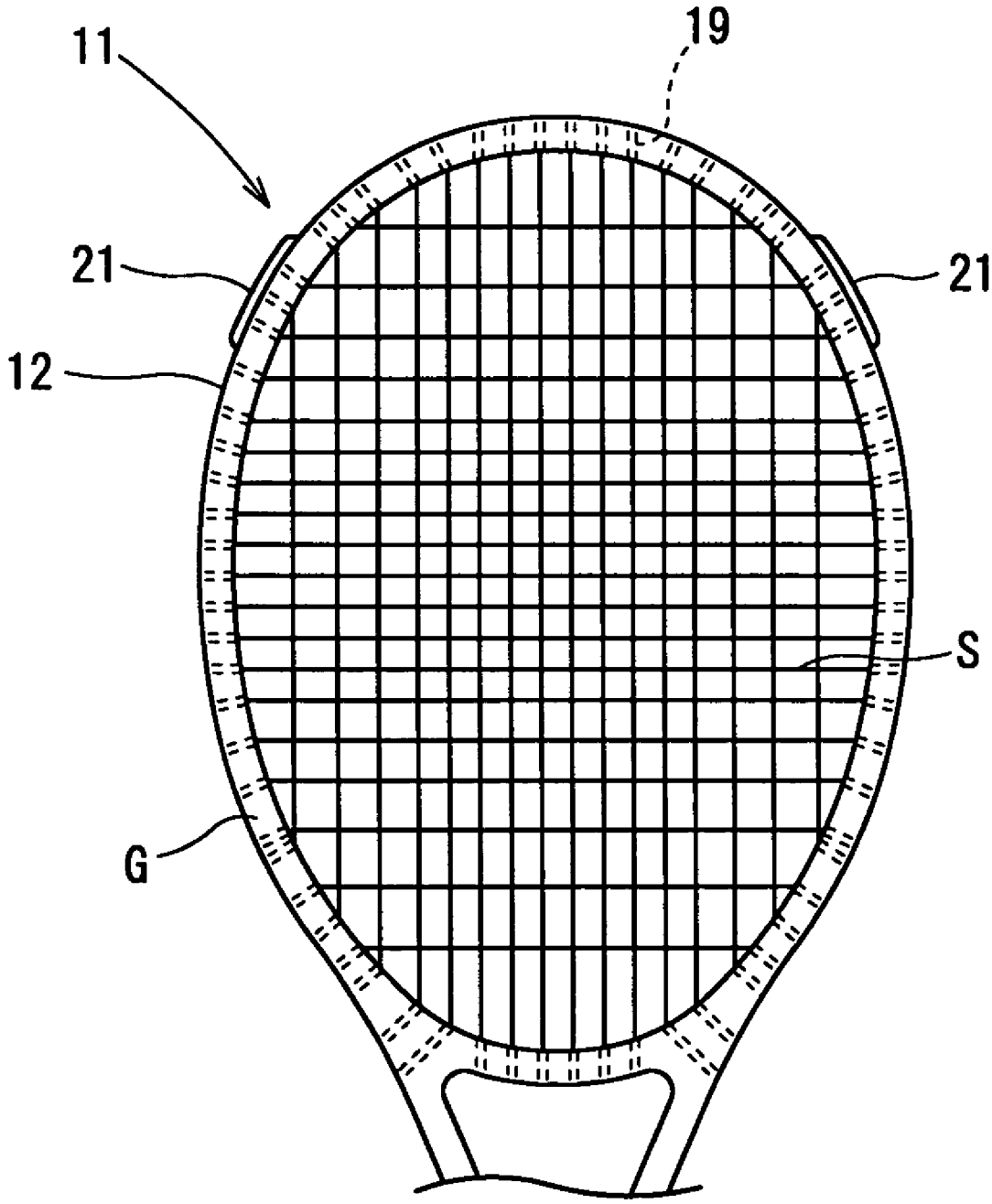
FIG. 4 is a front view showing a string-stretching part of the tennis racket shown in FIG. 1.

The racket frame 11 includes the head part 12, a throat part 13, a shaft part 14, and a grip part 15. These parts 12, 13, 14, and 15 are continuously formed. One end of a yoke 17 is connected to the one-side throat part 13, and the other end thereof is connected to the other-side throat part 13 so that the yoke 17 and the head part 12 form a string-stretching part G surrounding the ball-hitting face F. As shown in FIGS. 2 and 3, a groove portion 18 on which the viscoelastic member 31 and the string protection member 21 are mounted is circumferentially and continuously formed on the peripheral surface of the head part 12. As shown in FIG. 4, a plurality of string holes 19 through which strings S respectively are inserted are formed in and penetrate through the frame 11 in a direction perpendicular to the frame (thickness) direction of the frame 11. That is, the string holes 19 are formed on the frame 11 in its widthwise direction.

As shown in FIG. 2, the string protection member 21 has a plurality of cylindrical portions 22 in which string insertion holes 22*a* are respectively formed for inserting strings S therethrough. A belt-shaped portion 23 connects the cylindrical portions 22 to each other in such a way that the cylindrical portions 22 are projected inward. The belt-shaped portion 23 has a thickness of 1 mm and a large width corresponding to the thickness of the racket frame 11. The belt-shaped portion 23 has a string groove 24 formed at its center in its widthwise direction. The string protection member 21 has a configuration of an assembly of a grommet formed integrally with a bumper. The string protection member 21 is made of fiber reinforced resin so that the string protection member 21 is rigid. More specifically an epoxy resin is added to carbon fiber (RC: 43%).

The viscoelastic member 31 has a thickness of 3 mm and is substantially flat with a sectional configuration corresponding to that of the peripheral surface of the head part 12. A plurality of through-holes 32 through which the cylindrical portions 22 of the string protection member 21 are respectively inserted, extend through the viscoelastic member 31.

The viscoelastic member 31 is formed by molding rubber having a lower elastic modulus than that of the fiber reinforced resin of the string protection member 21. More specifically, the viscoelastic member 31 is formed by molding a vulcanized rubber composition consisting of 100 parts by weight of styrene-butadiene rubber, 1.5 parts by weight of sulfur, and 40 parts by weight of carbon black. The complex elastic modulus of the viscoelastic member 31 measured at a frequency of 10 Hz is not less than 2.0E+7 dyn/cm$^2$ nor more than 1.0E+10 dyn/cm$^2$ at temperatures in the range of 0° C. to 10° C.

With reference to FIG. 1, supposing that the midpoint of the maximum length of the ball-hitting face F of the racket frame 11 is denoted as a center O thereof and that the intersection of the longest line of the ball-hitting face F and the upper part of the ball-hitting face F is set as a 0-degree position, one string protection member 21 is mounted in a range A1 disposed from a clockwise 35-degree position to a clockwise ("clockwise" is omitted hereinafter) 55-degree position and a range A2 disposed from a 305-degree position to a 325-degree position. More specifically, supposing that the ball-hitting face F is regarded as a clock face, the string protection member 21 is mounted in the range A1 in which a 1.5 o'clock position is disposed at the central position and in the range A2 in which a 10.5 o'clock position is disposed at the central position. Therefore the ranges A1 and A2 form 20 degree respectively. Each string protection member 21 has a weight of 2 g.

When the string protection member 21 and the viscoelastic member 31 are mounted on the string-stretching part G of the racket frame 11, the cylindrical portions 22 of the string protection member 21 are inserted into the through-holes 32 of the viscoelastic member 31 respectively. Thereafter the viscoelastic member 31 is mounted on the inner peripheral side of the string protection member 21.

Thereafter all the cylindrical portions 22 of the string protection member 21 on which the viscoelastic member 31 has been mounted are inserted into the string holes 19 of the ranges A1 and A2 of the racket frame 11. Thereby as shown in FIG. 3B, the viscoelastic member 31 is interposed between the frame 11 and the string protection member 21 with the viscoelastic member 31 embedded in the groove portion 18 of the frame 11. Finally the strings S are mounted crosswise on the frame 11. Each viscoelastic member 31 has a weight of 3 g.

In the tennis racket 10 having the above-described construction, at least one portion of the range in which the string protection member 21 and the viscoelastic member 31 are mounted is included in the range from a 45-degree position to a 135-degree position and in the range from a 225-degree position to a 315-degree position.

The moment (Is) of inertia of the tennis racket 10 in the swing direction is set to is not less than 450,000 g/cm$^2$ nor more than 490,000 glcm$^2$, when the strings S are not tensionally mounted thereon. The moment (Ic) of inertia of the tennis racket 10 in the center direction is set to be not less than 15,000 g/cm$^2$ nor more than 19,000 g/cm$^2$, when the strings S are not tensionally mounted thereon.

By setting the moment of inertia to the above-described range, it is possible to maintain a high rebound performance and face stability. Thereby it is possible to improve the performance of the racket frame of repulsing a ball together with ball controllability thereof, in a favorable balance.

The total of the weight of the string protection member 21 and the viscoelastic member 31 is set to 5 g. Thus the tennis racket has an increase of only 10 g by the mounting of the string protection member 21 and the viscoelastic member 31 in the ranges A1 and A2. Therefore a preferable operability can be maintained without making the weight of the racket frame heavy.

The viscoelastic member 31 interposed between the frame 11 and the string protection member 21 is made of rubber having a lower elastic modulus than that of the material of the string protection member 21. Thus the viscoelastic member 31 is capable of effectively damping and absorbing vibrations of the strings generated when a ball is hit, which are transmitted to the frame 11. Further the string protection member 21 can be deformed by utilizing the deformability of the viscoelastic member 31. Thereby the racket frame is capable of enhancing the performance of repulsing the ball and improving the flight performance of the ball.

Because the string protection member 21 that contacts the string S directly is made of a fiber reinforced resin, the string protection member 21 has a certain degree of vibration-damping performance and yet has a necessary degree of rigidity. Therefore it is possible to increase the durability of the string protection member 21 and that of the frame 11.

Figure 5:
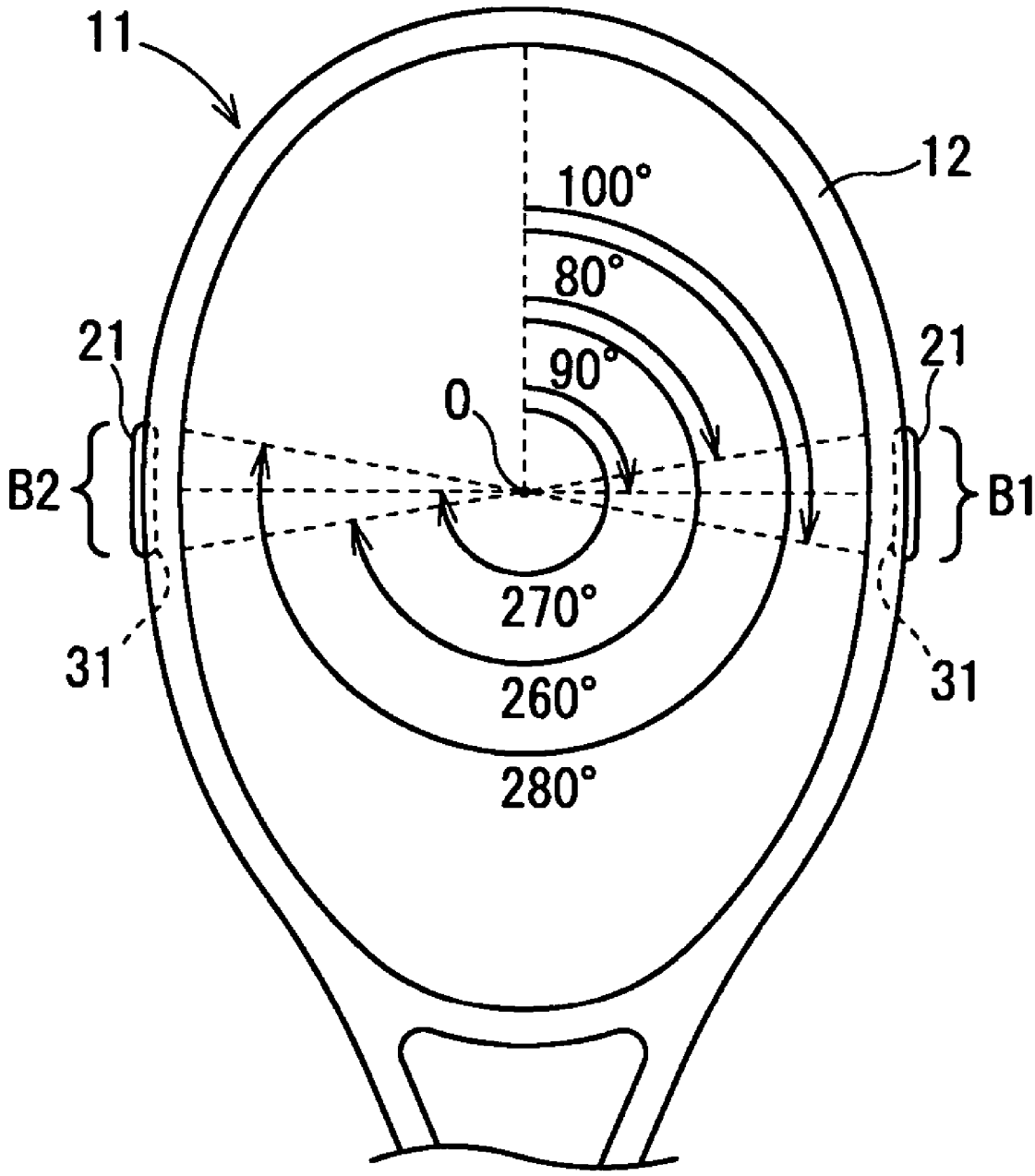
FIG. 5 is a front view showing a head part of a tennis racket of a second embodiment of the present invention.

FIG. 5 shows a second embodiment of the present invention. In the second embodiment, the string protection member 21 and the viscoelastic member 31 are mounted in a range B1 disposed from an 80-degree position to a 100-degree position and a range B2 disposed from a 260-degree position to a 280-degree position.

That is, supposing that the ball-hitting face F is regarded as the clock face, the string protection member 21 is mounted in the range B1 in which a 3 o'clock position is disposed at the central position and in the range B2 in which a 9 o'clock position is disposed at the central position. Therefore the ranges B1 and B2 form 20 degrees respectively.

Figure 6:
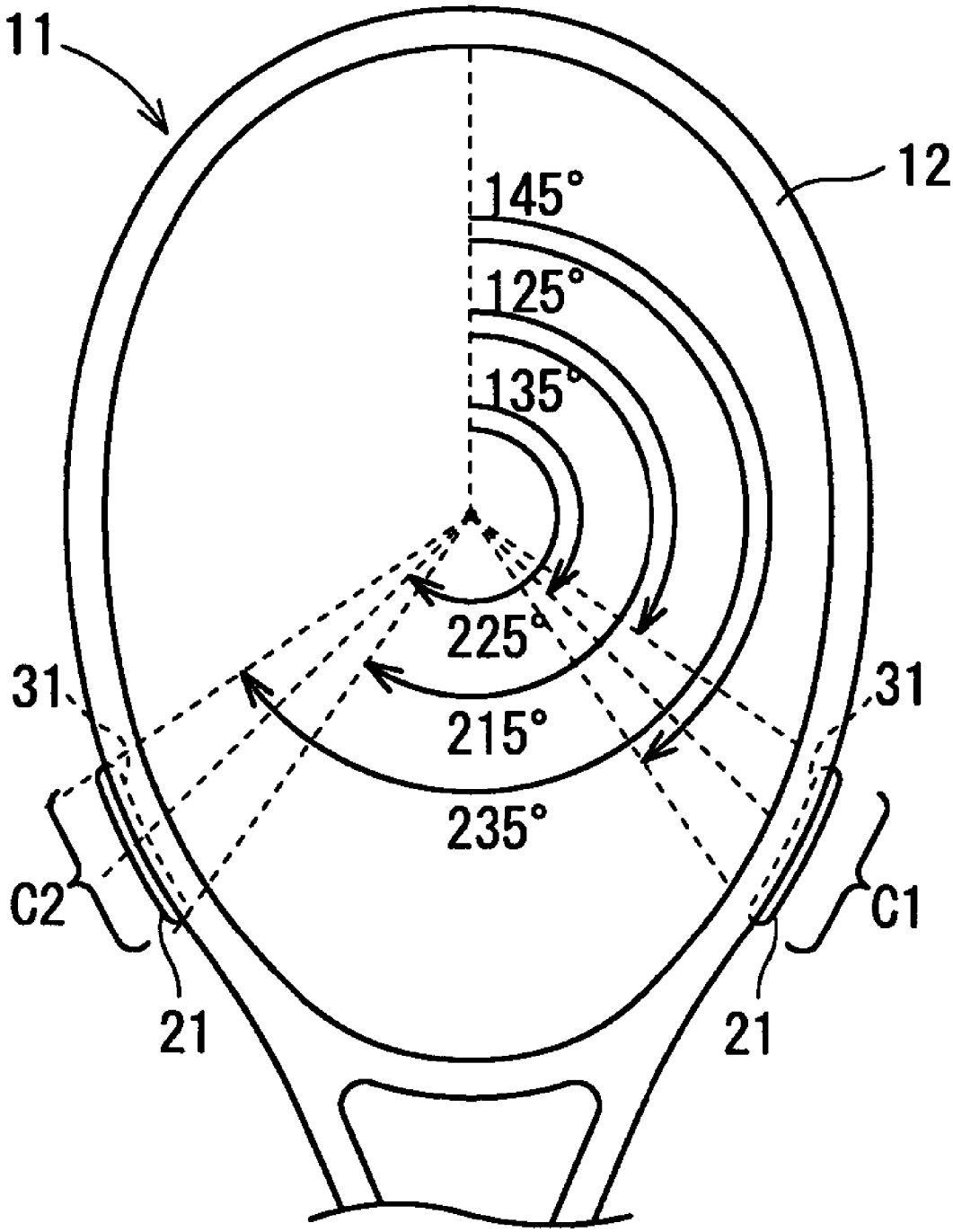
FIG. 6 is a front view showing a head part of a tennis racket of a third embodiment of the present invention.

FIG. 6 shows a third embodiment of the present invention. In the third embodiment, the string protection member 21 and the viscoelastic member 31 are mounted in a range C1 disposed from a 125-degree position to a 145-degree position and a range C2 disposed from a 215-degree position to a 235-degree position. That is, supposing that the ball-hitting face F is regarded as the clock face, the string protection member 21 is mounted in the range C1 in which a 4.5 o'clock position is disposed at the central position and in the range C2 in which a 7.5 o'clock position is disposed at the central position. Therefore the ranges C1 and C2 form 20 degrees respectively.

Figure 7:
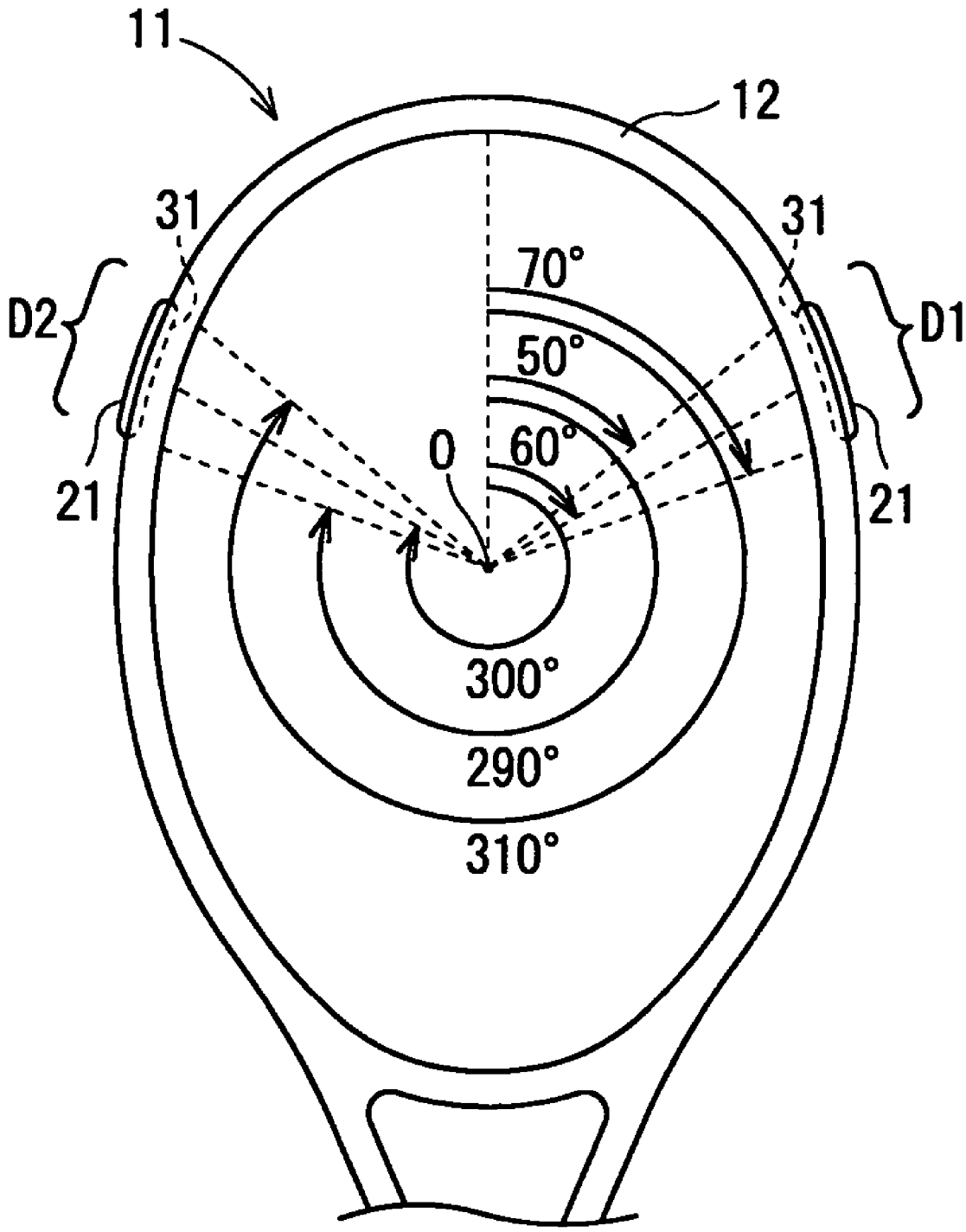
FIG. 7 is a front view showing a head part of a tennis racket of a fourth embodiment of the present invention.

FIG. 7 shows a fourth embodiment of the present invention. In the fourth embodiment, the string protection member 21 and the viscoelastic member 31 are mounted in a range D1 disposed from a 50-degree position to a 70-degree position and a range D2 disposed from a 290-degree position to a 310-degree position respectively. That is, supposing that the ball-hitting face F is regarded as the clock face, the string protection member 21 is mounted in the range D1 in which a 2 o'clock position is disposed at the central position and in the range D2 in which a 10 o'clock position is disposed at the central position. Therefore the ranges D1 and D2 form 20 degrees respectively.

Figure 8:
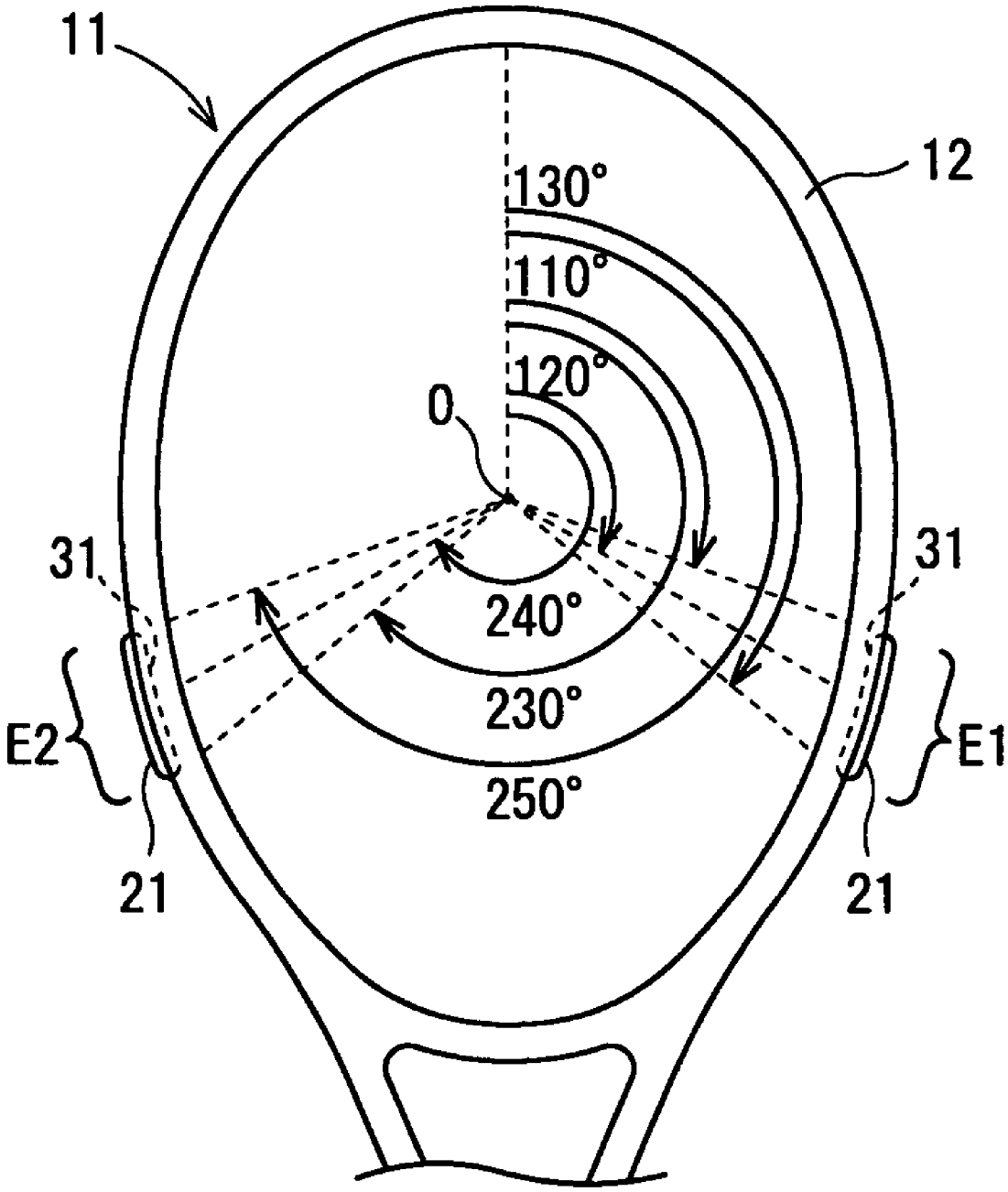
FIG. 8 is a front view showing the head part of the tennis racket of the fourth embodiment of the present invention.

FIG. 8 shows a fifth embodiment of the present invention. In the fifth embodiment, the string protection member 21 and the viscoelastic member 31 are mounted in a range E1 disposed from a 110-degree position to a 130-degree position and a range E2 disposed from a 230-degree position to a 250-degree position. That is, supposing that the ball-hitting face F is regarded as the clock face, the string protection member 21 is mounted in the range E1 in which a 4 o'clock position is disposed at the central position and in the range E2 in which an 8 o'clock position is disposed at the central position. Therefore the ranges E1 and E2 form 20 degrees respectively.

In each of the second embodiment through the fifth embodiment, the viscoelastic member 31 is formed by molding the vulcanized rubber composition consisting of 100 parts by weight of styrene-butadiene rubber, 1.5 parts by weight of sulfur, and 40 parts by weight of carbon black. The complex elastic modulus of the viscoelastic member 31 measured at a frequency of 10 Hz is not less than 2.0E+7 dyn/cm$^2$ nor more than 1.0E+10 dyn/cm$^2$ at temperatures in the range of 0° C. to 10° C. The tennis racket has an increase of only 10 g by the mounting of the string protection member 21 and the viscoelastic member 31 on the racket frame.

Since the constructions of the other parts are similar to those of the first embodiment, the same parts are denoted by the same reference numerals and description thereof is omitted herein.

At least one portion of the range in which the string protection member 21 and the viscoelastic member 31 are mounted is included in the range from the 45-degree position to the 135-degree position and in the range from the 225-degree position to the 315-degree position in each of the second embodiment in which the string protection member 21 and the viscoelastic member 31 are mounted on both side positions of the head part 12, the third and fifth embodiments in which the string protection member 21 and the viscoelastic member 31 are mounted on lower positions of the head part 12, and the fourth embodiment in which the string protection member 21 and the viscoelastic member 31 are mounted on upper positions of the head part 12. The moment (Is) of inertia of the tennis racket in the swing direction is set to not less than 450,000 g/cm$^2$ nor more than 490,000 g/cm$^2$, when the strings S are not tensionally mounted on the racket frame. The moment (Ic) of inertia of the tennis racket in the center direction is set to not less than 15,000 g/cm$^2$ nor more than 19,000 g/cm$^2$, when the strings S are not tensionally mounted on the racket frame. Thereby the frame 11 is capable of maintaining a high rebound performance and enhancing its face stability and hence improving its rebound performance and ball controllability in a favorable balance. The viscoelastic member 31 absorbs vibrations of the strings, thereby damping vibrations of the frame 11 sufficiently.

Figure 9:
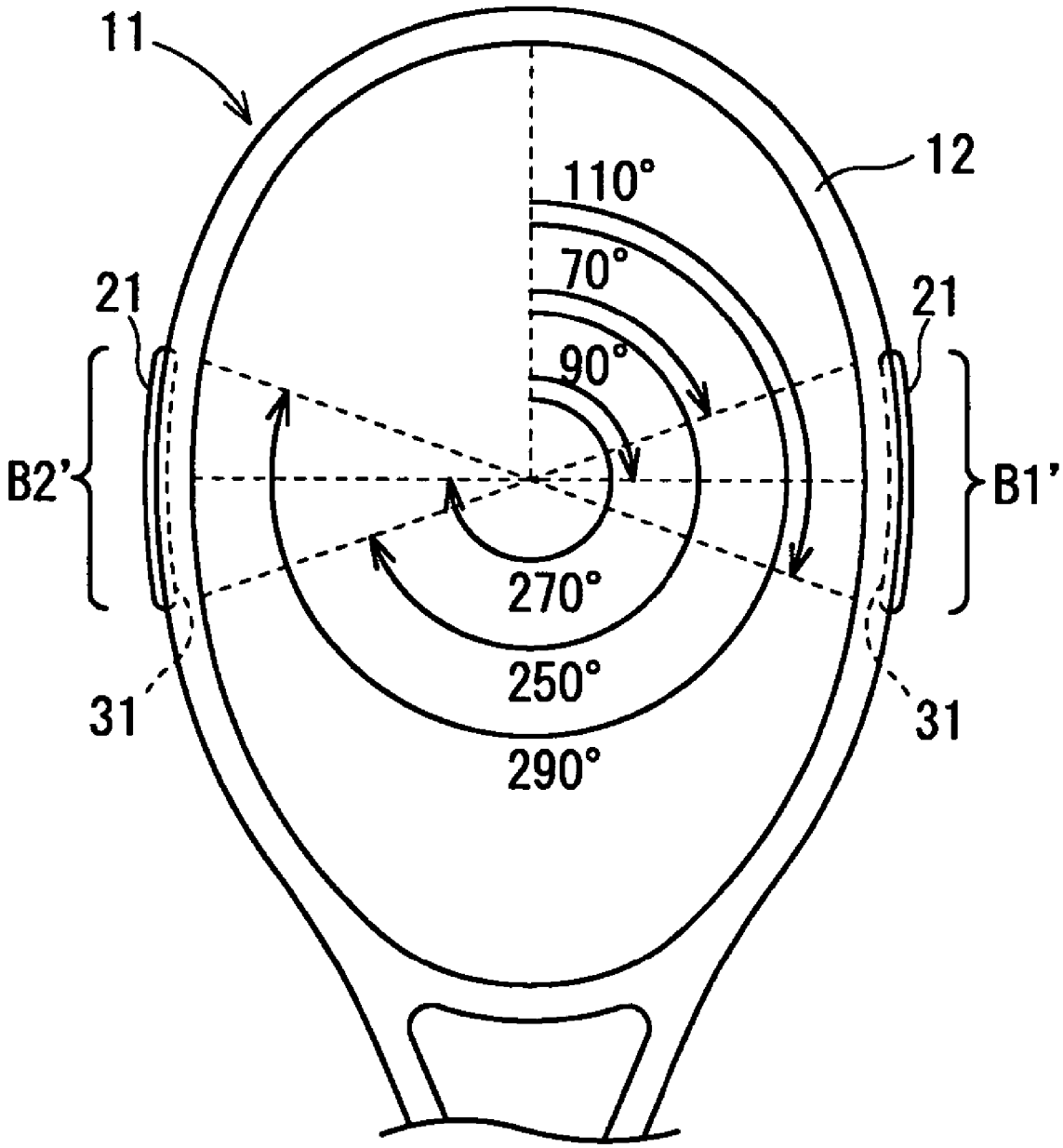
FIG. 9 is a front view showing a head part of a tennis racket of a sixth embodiment of the present invention.

FIG. 9 shows a sixth embodiment of the present invention. In the sixth embodiment, the string protection member 21 and the viscoelastic member 31 are mounted in a range B1' disposed from a 70-degree position to a 110-degree position and a range B2' disposed from a 250-degree position to a 290-degree position. That is, supposing that the ball-hitting face F is regarded as the clock face, the string protection member 21 is mounted in the range B1' in which the 3 o'clock position is disposed at the central position and in the range B2' in which the 9 o'clock position is disposed at the central position. Therefore the ranges E1 and E2 form 40 degrees respectively. The string protection member 21 has a thickness of 2 mm and a weight of 4 g. The viscoelastic member 31 has a thickness of 5 mm and a weight of 5 g.

Since the constructions of the other parts are similar to those of the first embodiment, the same parts are denoted by the same reference numerals and description thereof is omitted herein.

In the sixth embodiment, the string protection member 21 and the viscoelastic member 31 are thick and disposed in a long range. Thus the total weight of the tennis racket increases by 18 g. However, the tennis racket is capable of displaying the effect of the present invention effectively. Therefore the moment (Is) of inertia of the tennis racket in the swing direction is not less than 450,000 g/cm$^2$ nor more than 490,000 g/cm$^2$, when the strings S are not tensionally mounted on the racket frame. The moment (Ic) of inertia of the tennis racket in the center direction is not less than 15,000 g/cm$^2$ nor more than 19,000 g/cm$^2$, when the strings S are not tensionally mounted on the racket frame. Thereby the frame is capable of maintaining a high rebound performance and enhancing its face stability and hence improving its rebound performance and ball controllability in a favorable balance.

EXAMPLES

A tennis racket of each of the examples 1 through 10 and comparison examples 1 through 9 was prepared to evaluate the characteristics thereof by measuring the coefficient of restitution and the like of each tennis racket.

As shown in tables 1 through 3, the tennis rackets were prepared by differentiating the mounting position of the string protection member and the viscoelastic member; and the material, complex elastic modulus, and thickness of the viscoelastic member. The coefficient of restitution, sweet area, and vibration-damping factor of each tennis racket were measured. A ball-hitting test was also conducted.

The complex elastic moduli shown in tables 1 and 2 were measured by using a DVE-V4 produced by Leology Inc. at 5° C. under the conditions shown below. In the tennis racket of the examples 1 through 6, 8, 9 and the comparison examples 4 through 9, the complex elastic modulus of the viscoelastic member was not less than 2.0E+7 dyn/cm$^2$ nor more than 1.0E+10 dyn/cm$^2$ at temperatures in the range of 0° C. to 10° C.:

Specimen: 5 mm (width)×30 mm (length)×2 mm (thickness)

Length of deformed portion of specimen: 20 mm (both sides having length of 5 mm were supported)

Initial strain: 10% (2 mm)

Amplitude: 12 μm

Frequency: 10 Hz

Mode: Stretching mode

The "mounted position" shown in tables 1 and 2 means the position where the string protection member was mounted, with the viscoelastic member interposed between the string protection member and the frame. Each mounted position is indicated by an hour in the right-hand side of the head part in the range from 12 o'clock to 6 o'clock. The string protection member is mounted symmetrically in the left-to-right direction. Therefore when the mounted position is 3 o'clock, the string protection member is mounted at a 3-o'clock position and a 9-o'clock position.

The total weight of the viscoelastic member and the string protection member means the sum of the weight of the viscoelastic member and the string protection member at the left-hand side and the weight thereof at the right-hand side. Thus when the viscoelastic member and the string protection member are mounted at the 3-o'clock position and the 9-o'clock position, the total weight of the viscoelastic member and the string protection member is described as 5 g×2=10 g.

The weight of the viscoelastic member is the weight of one viscoelastic member. The weight of the string protection member is the weight of one string protection member.

Table 3 shows a start position, a termination position, and a center position of the string protection member of each of the examples and the comparison examples.

TABLE 1

| | | Example ① | Example ② | Example ③ | Example ④ | Example ⑤ |
|---|---|---|---|---|---|---|
| Mounted position | | 1.5 o'clock | 3 o'clock | 4.5 o'clock | 3 o'clock | 2 o'clock |
| Total weight of viscoelastic member and string protection member | | 10 g | 10 g | 10 g | 18 g | 10 g |
| Viscoelastic member | Kind | SBR + Carbon | SBR + Carbon | SBR + Carbon | SBR + Carbon | SBR + Carbon |
| | Complex elastic modulus [dyn/cm$^2$] | 3.86E + 08 | 3.86E + 08 | 3.86E + 08 | 3.86E + 08 | 3.86E + 08 |
| | Thickness [mm] | 3 | 3 | 3 | 5 | 3 |
| | Weight [g] | 3 | 3 | 3 | 5 | 3 |
| String protection member | Weight [g] | 2 | 2 | 2 | 4 | 2 |
| Weight of frame | [g] | 240 | 239 | 240 | 247 | 239 |
| Balance | [mm] | 363 | 361 | 359 | 365 | 362 |
| Moment of inertia | Is (swing direction) [g · cm$^2$] | 460,000 | 456,000 | 450,000 | 476,000 | 458,000 |
| | Ic (center direction) [g · cm$^2$] | 16,300 | 17,200 | 16,400 | 18,700 | 16,800 |
| | | 28 | 27 | 27 | 25 | 27 |
| Coefficient of restitution | [−] | 0.416 | 0.424 | 0.418 | 0.430 | 0.420 |
| Sweet area (coefficient of restitution not less than 0.38) [cm$^2$] | | 70 | 68 | 70 | 76 | 69 |
| Vibration-damping factor | Primary out-of-plane [%] | 0.51 | 0.50 | 0.70 | 0.55 | 0.50 |
| | Secondary out-of-plane [%] | 0.50 | 0.70 | 0.45 | 0.75 | 0.60 |
| Evaluation by ball-hitting | Operability | 4.0 | 4.1 | 4.2 | 3.6 | 4.0 |
| | Face stability | 3.8 | 4.1 | 3.8 | 4.5 | 3.9 |

TABLE 1-continued

| | | | | | | |
|---|---|---|---|---|---|---|
| | Ball-flying performance | 3.8 | 4.0 | 3.6 | 4.2 | 3.8 |
| | Vibration-damping performance | 3.8 | 4.0 | 4.0 | 4.0 | 3.7 |

| | | Example ⑥ | Example ⑦ | Example ⑧ | Example ⑨ | Example ⑩ |
|---|---|---|---|---|---|---|
| Mounted position | | 4 o'clock | 3 o'clock | 3 o'clock | 3 o'clock | 3 o'clock |
| Total weight of viscoelastic member and string protection member | | 10 g | 10 g | 10 g | 10 g | 10 g |
| Viscoelastic member | Kind | SBR + Carbon | silicon | SBR | PEBAX5533 | 11-NYLON |
| | Complex elastic modulus [dyn/cm$^2$] | 3.86E + 08 | 1.41 + 07 | 5.07E + 07 | 2.72E + 09 | 1.45E + 10 |
| | Thickness [mm] | 3 | 3 | 3 | 3 | 3 |
| | Weight [g] | 3 | 3 | 3 | 3 | 3 |
| String protection member | Weight [g] | 2 | 2 | 2 | 2 | 2 |
| Weight of frame | [g] | 239 | 239 | 239 | 239 | 239 |
| Balance | [mm] | 360 | 361 | 361 | 361 | 361 |
| Moment of inertia | Is (swing direction) [g · cm$^2$] | 453,000 | 456,000 | 455,000 | 455,000 | 456,000 |
| | Ic (center direction) [g · cm$^2$] | 169,000 | 17,200 | 17,300 | 17,300 | 17,200 |
| | | 27 | 27 | 26 | 26 | 27 |
| Coefficient of restitution | [−] | 0.421 | 0.416 | 0.421 | 0.423 | 0.414 |
| Sweet area (coefficient of restitution not less than 0.38) [cm$^2$] | | 69 | 59 | 67 | 68 | 58 |
| Vibration-damping factor | Primary out-of-plane [%] | 0.61 | 0.30 | 0.45 | 0.45 | 0.30 |
| | Secondary out-of-plane [%] | 0.60 | 0.33 | 0.60 | 0.55 | 0.35 |
| Evaluation by ball-hitting | Operability | 4.1 | 4.1 | 4.0 | 4.0 | 4.1 |
| | Face stability | 3.9 | 4.0 | 4.1 | 4.1 | 4.1 |
| | Ball-flying performance | 3.9 | 3.8 | 3.9 | 4.0 | 3.7 |
| | Vibration-damping performance | 3.9 | 3.0 | 3.7 | 3.6 | 3.1 |

TABLE 2

| | | Comparison Example ① | Comparison Example ② | Comparison Example ③ | Comparison Example ④ | Comparison Example ⑤ |
|---|---|---|---|---|---|---|
| Mounted position | | Not mounted | 3 o'clock | 3 o'clock | TOP | TOP |
| Total weight of viscoelastic member and string protection member | | | 10 g | 24 g | 5 g | 15 g |
| Viscoelastic member | Kind | Not mounted | Lead | Lead | SBR + Carbon | SBR + Carbon |
| | Complex elastic modulus [dyn/cm$^2$] | | | | 3.86E + 08 | 3.86E + 08 |
| | Thickness [mm] | | | | 3 | 3 |
| | Weight [g] | | | | 3 | 9 |
| String protection member | Weight [g] | Not mounted | Not mounted | Not mounted | 2 | 6 |
| Weight of frame | [g] | 230 | 239 | 240 | 234 | 244 |
| Balance | [mm] | 355 | 361 | 360 | 363 | 375 |
| Moment of inertia | Is (swing direction) [g · cm$^2$] | 434,000 | 456,000 | 450,000 | 450,000 | 500,000 |
| | Ic (center direction) [g · cm$^2$] | 14,300 | 17,200 | 19,200 | 14,400 | 14,400 |
| | | 30 | 27 | 23 | 31 | 35 |
| Coefficient of restitution | [−] | 0.400 | 0.410 | 0.412 | 0.405 | 0.407 |
| Sweet area (coefficient of restitution not less than 0.38) [cm$^2$] | | 32 | 53 | 45 | 44 | 49 |
| Vibration-damping factor | Primary out-of-plane [%] | 0.30 | 0.32 | 0.32 | 0.40 | 0.45 |
| | Secondary out-of-plane [%] | 0.29 | 0.30 | 0.33 | 0.41 | 0.50 |
| Evaluation by ball-hitting | Operability | 4.5 | 4.2 | 4.0 | 4.2 | 3.0 |
| | Face stability | 3.0 | 4.0 | 4.3 | 3.2 | 3.3 |
| | Ball-flying performance | 2.9 | 3.3 | 3.3 | 3.1 | 3.2 |
| | Vibration-damping performance | 2.8 | 3.0 | 3.0 | 3.5 | 3.6 |

| | | Comparison Example ⑥ | | Comparison Example ⑦ | | Comparison Example ⑧ | Comparison Example ⑨ |
|---|---|---|---|---|---|---|---|
| Mounted position | | TOP | 3 o'clock | TOP | Yoke | 3 o'clock | 3 o'clock |
| Total weight of viscoelastic member and string protection member | | 5 g | 10 g | 5 g | 5 g | 24 g | 6 g |
| Viscoelastic member | Kind | SBR + Carbon | | SBR + Carbon | | SBR + Carbon | SBR + Carbon |
| | Complex elastic modulus [dyn/cm$^2$] | 3.86E + 08 | | 3.86E + 08 | | 3.86E + 08 | 3.86E + 08 |
| | Thickness [mm] | 3 | | 3 | | 7 | 1 |
| | Weight [g] | 3 | | 3 | | 7 | 1 |
| String protection member | Weight [g] | 2 | | 2 | | 5 | 2 |
| Weight of frame | [g] | 244 | | 240 | | 253 | 235 |
| Balance | [mm] | 372 | | 363 | | 370 | 359 |
| Moment of inertia | Is (swing direction) [g · cm$^2$] | 497,000 | | 470,000 | | 510,000 | 443,000 |
| | Ic (center direction) [g · cm$^2$] | 17,900 | | 14,500 | | 19,200 | 16,400 |
| | | 28 | | 32 | | 27 | 27 |

TABLE 2-continued

| | | | | | |
|---|---|---|---|---|---|
| Coefficient of restitution | [−] | 0.427 | 0.410 | 0.438 | 0.416 |
| Sweet area (coefficient of restitution not less than 0.38) [cm$^2$] | | 70 | 46 | 88 | 60 |
| Vibration-damping factor | Primary out-of-plane [%] | 0.52 | 0.70 | 0.52 | 0.50 |
| | Secondary out-of-plane [%] | 0.75 | 0.42 | 0.90 | 0.50 |
| Evaluation by ball-hitting | Operability | 3.0 | 3.8 | 2.9 | 4.3 |
| | Face stability | 4.4 | 3.3 | 4.6 | 3.8 |
| | Ball-flying performance | 4.0 | 3.2 | 4.5 | 3.6 |
| | Vibration-damping performance | 4.0 | 4.0 | 4.3 | 3.8 |

TABLE 3

| | Number of string protection members | Start position (angle) of string protection member | Termination position (angle) of string protection member | Center position (angle) of string protection member |
|---|---|---|---|---|
| Comparison Example 4 | 1 | 350 | 10 | 0 |
| Comparison Example 5 | 1 | 330 | 30 | 0 |
| Example 1 | 2 | 35 | 55 | 45 |
| | | 325 | 305 | 315 |
| Example 2 | 2 | 80 | 100 | 90 |
| | | 280 | 260 | 270 |
| Example 3 | 2 | 125 | 145 | 135 |
| | | 235 | 215 | 225 |
| Comparison Example 6 | 3 | 350 | 10 | 0 |
| | | 80 | 100 | 90 |
| | | 280 | 260 | 270 |
| Comparison Example 7 | 2 | 350 | 10 | 0 |
| | | 170 | 190 | 180 |
| Example 4 | 2 | 70 | 110 | 90 |
| | | 290 | 250 | 270 |
| Comparison Example 8 | 2 | 65 | 115 | 90 |
| | | 295 | 245 | 270 |
| Comparison Example 9 | 2 | 80 | 100 | 90 |
| | | 280 | 260 | 270 |
| Example 7 | 2 | 80 | 100 | 90 |
| | | 280 | 260 | 270 |
| Example 8 | 2 | 80 | 100 | 90 |
| | | 280 | 260 | 270 |
| Example 9 | 2 | 80 | 100 | 90 |
| | | 280 | 260 | 270 |
| Example 10 | 2 | 80 | 100 | 90 |
| | | 280 | 260 | 270 |
| Example 5 | 2 | 50 | 70 | 60 |
| | | 310 | 290 | 300 |
| Example 6 | 2 | 110 | 130 | 120 |
| | | 250 | 230 | 240 |

The racket frames 11 of the examples 1 through 10 and the comparison examples 1 through 9 were made of fiber reinforced resin and hollow. The racket frames had the same configurations and had a thickness of 28 mm and a width of 13 to 16 mm. The area of the ball-hitting face F was 115 square inches. The weight of each racket frame and the balance thereof were set as shown in table 1.

More specifically, prepreg sheets (CF prepreg (T300, T700, T800, M46J manufactured by Toray Industries Inc.) composed of thermosetting resin reinforced with carbon fiber were layered one upon another on a mandrel (ϕ14.5 mm) covered with an internal-pressure tube made of nylon 66 was fitted. Thereby a cylindrical laminate was formed. The prepreg sheets were layered one upon another at angles of 0°, 22°, 30°, and 90°. After the mandrel was removed from the laminate, the laminate was set in a die. After the die was clamped, the die was heated at 150° C. for 30 minutes, with an air pressure of 9 kgf/cm$^2$ kept applied to the inside of the inner-pressure tube.

In each of the racket frames of the examples 1 through 10 and the comparison examples 1 through 9, the string protection member 21 was formed by molding a mixture of carbon fiber and epoxy resin.

Example 1

The thickness, weight, and position of the string protection member 21 and the material, complex elastic modulus, thickness, weight, and position of the viscoelastic member 31 were all identical to those of the first embodiment. That is, the viscoelastic member 31 was formed by molding a vulcanized rubber composition consisting of 100 parts by weight of styrene-butadiene rubber (SBR), 1.5 parts by weight of sulfur, and 40 parts by weight of carbon black. The viscoelastic member 31 had a thickness of 3 mm and a weight of 3 g. The complex elastic modulus of the viscoelastic member 31 measured in the above-described condition was 3.86E+08 dyn/cm$^2$. The string protection member 21 had a thickness of 1 mm and a weight of 2 g. One string protection member 21 and one viscoelastic member 31 were disposed in each of the above-described ranges A1 and A2. The tennis racket 10 had a weight of 240 g.

The moment Is of inertia of the tennis racket in the swing direction was set to 460,000 g/cm$^2$, and the moment Ic of inertia thereof in the center direction was set to 16,300 g/cm$^2$ (the ratio of the moment Is of inertia to the moment Ic of inertia: about 28). In measuring the moment of inertia, the strings were not mounted on the racket frame.

Example 2

The thickness, weight, and position of the string protection member 21 and the material, complex elastic modulus, thickness, weight, and position of the viscoelastic member 31 were all identical to those of the second embodiment (FIG. 5). That is, the example 2 is different from the example 1 in that one string protection member 21 and one viscoelastic member 31 were disposed in each of the above-described ranges B1 and B2. The tennis racket 10 had a weight of 239 g. The moment Is of inertia of the tennis racket in the swing direction when strings were not mounted on the racket frame was set to 456,000 g/cm$^2$. The moment Ic of inertia thereof in the center direction when strings were not mounted on the racket frame was set to 17,200 g/cm$^2$ (the ratio of the moment Is of inertia to the moment Ic of inertia: about 27).

Example 3

The thickness, weight, and position of the string protection member 21 and the material, complex elastic modulus, thickness, weight, and position of the viscoelastic member 31 were all identical to those of the third embodiment (FIG. 6). That is, the example 3 is different from the example 1 in that one string protection member 21 and one viscoelastic member 31 were disposed in each of the above-described ranges C1 and C2. The tennis racket 10 had a weight of 240 g. The moment Is of inertia of the tennis racket in the swing direction when strings were not mounted on the racket frame was set to 450,000 g/cm$^2$. The moment Ic of inertia thereof in the center direction when strings were not mounted on the racket frame was set to 16,400 g/cm$^2$ (the ratio of the moment Is of inertia to the moment Ic of inertia: about 27).

Example 4

The thickness, weight, and position of the string protection member 21 and the material, complex elastic modulus, thickness, weight, and position of the viscoelastic member 31 were all identical to those of the sixth embodiment (FIG. 9). That is, the example 4 is different from the example 1 in that one string protection member 21 and one viscoelastic member 31 were disposed in each of the above-described ranges B1' and B2'. The viscoelastic member 31 had a thickness of 5 mm and a weight of 5 g. The string protection member 21 had a thickness of 2 mm and a weight of 4 g. The tennis racket 10 had a weight of 247 g. The moment Is of inertia of the tennis racket in the swing direction when strings were not mounted on the racket frame was set to 476,000 g/cm$^2$. The moment Ic of inertia thereof in the center direction when strings were not mounted on the racket frame was set to 18,700 g/cm$^2$ (the ratio of the moment Is of inertia to the moment Ic of inertia: about 25).

Example 5

The thickness, weight, and position of the string protection member 21 and the material, complex elastic modulus, thickness, weight, and position of the viscoelastic member 31 were all identical to those of the fourth embodiment (FIG. 7). That is, the example 5 is different from the example 1 in that one string protection member 21 and one viscoelastic member 31 were disposed in each of the above-described ranges D1 and D2. The tennis racket 10 had a weight of 239 g. The moment Is of inertia of the tennis racket in the swing direction when strings were not mounted on the racket frame was set to 458,000 g/cm$^2$. The moment Ic of inertia thereof in the center direction when strings were not mounted on the racket frame was set to 16,800 g/cm$^2$ (the ratio of the moment Is of inertia to the moment Ic of inertia: about 27).

Example 6

The thickness, weight, and position of the string protection member 21 and the material, complex elastic modulus, thickness, weight, and position of the viscoelastic member 31 were all identical to those of the fifth embodiment (FIG. 8). That is, the example 6 is different from the example 1 in that one string protection member 21 and one viscoelastic member 31 were disposed in each of the above-described ranges E1 and E2. The tennis racket 10 had a weight of 239 g. The moment Is of inertia of the tennis racket in the swing direction when strings were not mounted on the racket frame was set to 453,000 g/cm$^2$. The moment Ic of inertia thereof in the center direction when strings were not mounted on the racket frame was set to 16,900 g/cm$^2$ (the ratio of the moment Is of inertia to the moment Ic of inertia: about 27).

Example 7

The material of the viscoelastic member 31 of the example 2 was varied to form the viscoelastic member 31 of the example 7. More specifically, one string protection member 21 and one viscoelastic member 31 were disposed in each of the above-described ranges B1 and B2. The viscoelastic member 31 was formed by molding silicone rubber. The viscoelastic member 31 had a thickness of 3 mm and a weight of 3 g. The complex elastic modulus of the viscoelastic member 31 measured in the above-described condition was 1.41E+07 dyn/cm$^2$. The string protection member 21 had a thickness of 1 mm and a weight of 2 g. The tennis racket 10 had a weight of 239 g.

The moment Is of inertia of the tennis racket in the swing direction when strings were not mounted on the racket frame was set to 456,000 g/cm$^2$. The moment Ic of inertia thereof in the center direction when strings were not mounted on the racket frame was set to 17,200 g/cm$^2$ (the ratio of the moment Is of inertia to the moment Ic of inertia: about 27).

Example 8

The material of the viscoelastic member 31 of the example 2 was varied to form the viscoelastic member 31 of the example 8. More specifically, the viscoelastic member 31 was formed by molding a vulcanized rubber composition consisting of 100 parts by weight of styrene-butadiene rubber (SBR) and 1.5 parts by weight of sulfur. The viscoelastic member 31 had a thickness of 3 mm and a weight of 3 g. The complex elastic modulus of the viscoelastic member 31 measured in the above-described condition was 5.07E+07 dyn/cm$^2$. The string protection member 21 had a thickness of 1 mm and a weight of 2 g. One string protection member 21 and one viscoelastic member 31 were disposed in each of the above-described ranges B1 and B2. The tennis racket 10 had a weight of 239 g.

The moment Is of inertia of the tennis racket in the swing direction when strings were not mounted on the racket frame was set to 455,000 g/cm$^2$. The moment Ic of inertia thereof in the center direction when strings were not mounted on the racket frame was set to 17,300 g/cm$^2$ (the ratio of the moment Is of inertia to the moment Ic of inertia: about 26).

Example 9

The material of the viscoelastic member 31 of the example 2 was varied to form the viscoelastic member 31 of the example 9. More specifically, the viscoelastic member 31 was formed by molding PEBAX5533 (produced by ATOCHEM Inc.). The viscoelastic member 31 had a thickness of 3 mm and a weight of 3 g. The complex elastic modulus of the viscoelastic member 31 measured in the above-described condition was 2.72E+09 dyn/cm$^2$. The string protection member 21 had a thickness of 1 mm and a weight of 2 g. One string protection member 21 and one viscoelastic member 31 were disposed in each of the above-described ranges B1 and B2. The tennis racket 10 had a weight of 239 g.

The moment Is of inertia of the tennis racket in the swing direction when strings were not mounted on the racket frame was set to 455,000 g/cm$^2$. The moment Ic of inertia thereof in the center direction when strings were not mounted on the racket frame was set to 17,300 g/cm$^2$ (the ratio of the moment Is of inertia to the moment Ic of inertia: about 26).

Example 10

The material of the viscoelastic member 31 of the example 2 was varied to form the viscoelastic member 31 of the example 10. More specifically, the viscoelastic member 31 was formed by molding nylon 11. The viscoelastic member 31 had a thickness of 3 mm and a weight of 3 g. The complex elastic modulus of the viscoelastic member 31 measured in the above-described condition was 1.45 E+10 dyn/cm$^2$. The string protection member 21 had a thickness of 1 mm and a weight of 2 g. One string protection member 21 and one viscoelastic member 31 were disposed in each of the above-described ranges B1 and B2. The tennis racket 10 had a weight of 239 g.

The moment Is of inertia of the tennis racket in the swing direction when strings were not mounted on the racket frame was set to 456,000 g/cm$^2$. The moment Ic of inertia thereof in the center direction when strings were not mounted on the racket frame was set to 17,200 g/cm$^2$ (the ratio of the moment Is of inertia to the moment Ic of inertia: about 27).

Comparison Example 1

Neither the string protection member 21 nor the viscoelastic member 31 was mounted on the racket frame 11. The tennis racket had a weight of 230 g. The moment Is of inertia of the tennis racket in the swing direction when strings were not mounted on the racket frame was set to 434,000 g/cm$^2$. The moment Ic of inertia thereof in the center direction when strings were not mounted on the racket frame was set to 14,300 g/cm$^2$ (the ratio of the moment Is of inertia to the moment Ic of inertia: about 30).

Comparison Example 2

Let it be supposed that the 0-degree position of the frame 11 is the 12 o'clock position of a clock. Five grams of lead was mounted on the 3 o'clock position (90-degree position) and the 9 o'clock position (270-degree position). The tennis racket had a weight of 239 g. The moment Is of inertia of the tennis racket in the swing direction when strings were not mounted on the racket frame was set to 456,000 g/cm$^2$. The moment Ic of inertia thereof in the center direction when strings were not mounted on the racket frame was set to 17,200 g/cm$^2$ (the ratio of the moment Is of inertia to the moment Ic of inertia: about 27).

Comparison Example 3

The weight of the frame 11 was reduced by 14 g. Twelve grams of lead was mounted on the 3 o'clock position and the 9 o'clock position. The tennis racket had a weight of 240 g. The moment Is of inertia of the tennis racket in the swing direction when strings were not mounted on the racket frame was set to 450,000 g/cm$^2$. The moment Ic of inertia thereof in the center direction when strings were not mounted on the racket frame was set to 19,200 g/cm$^2$ (the ratio of the moment Is of inertia to the moment Ic of inertia: about 23).

Comparison Example 4

Figure 10:
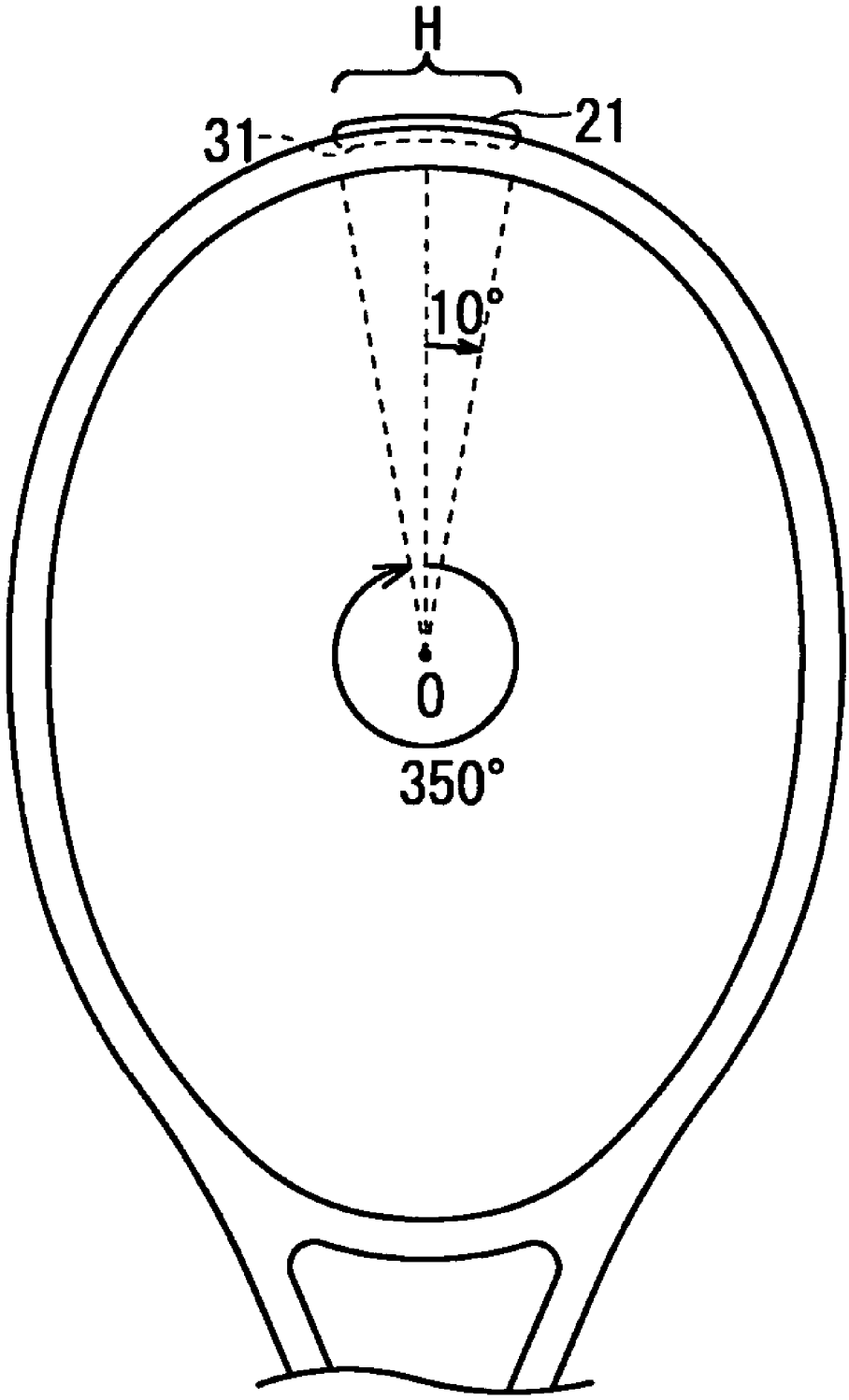
FIG. 10 is a front view showing a head part of a tennis racket of a comparison example 4.

As shown in FIG. 10, one string protection member 21 and one viscoelastic member 31 were mounted in a range H forming 20 degrees in the range from a 350-degree position to a 10-degree position, with the center of the string protection member 21 and the viscoelastic member 31 disposed at the top position of the head part 12 of the frame 11. The viscoelastic member 31 was formed by molding a vulcanized rubber composition consisting of 100 parts by weight of styrene-butadiene rubber (SBR), 1.5 parts by weight of sulfur, and 40 parts by weight of carbon black. The viscoelastic member 31 had a thickness of 3 mm and a weight of 3 g. The complex elastic modulus of the viscoelastic member 31 measured in the above-described condition was 3.86E+08 dyn/cm$^2$. The string protection member 21 had a thickness of 1 mm and a weight of 2 g. The tennis racket had a weight of 234 g.

The moment Is of inertia of the tennis racket of the comparison example 4 in the swing direction when strings were not mounted on the racket frame was set to 450,000 g/cm$^2$. The moment Ic of inertia thereof in the center direction when strings were not mounted on the racket frame was set to 14,400 g/cm$^2$ (the ratio of the moment Is of inertia to the moment Ic of inertia: about 31).

Comparison Example 5

Figure 11:
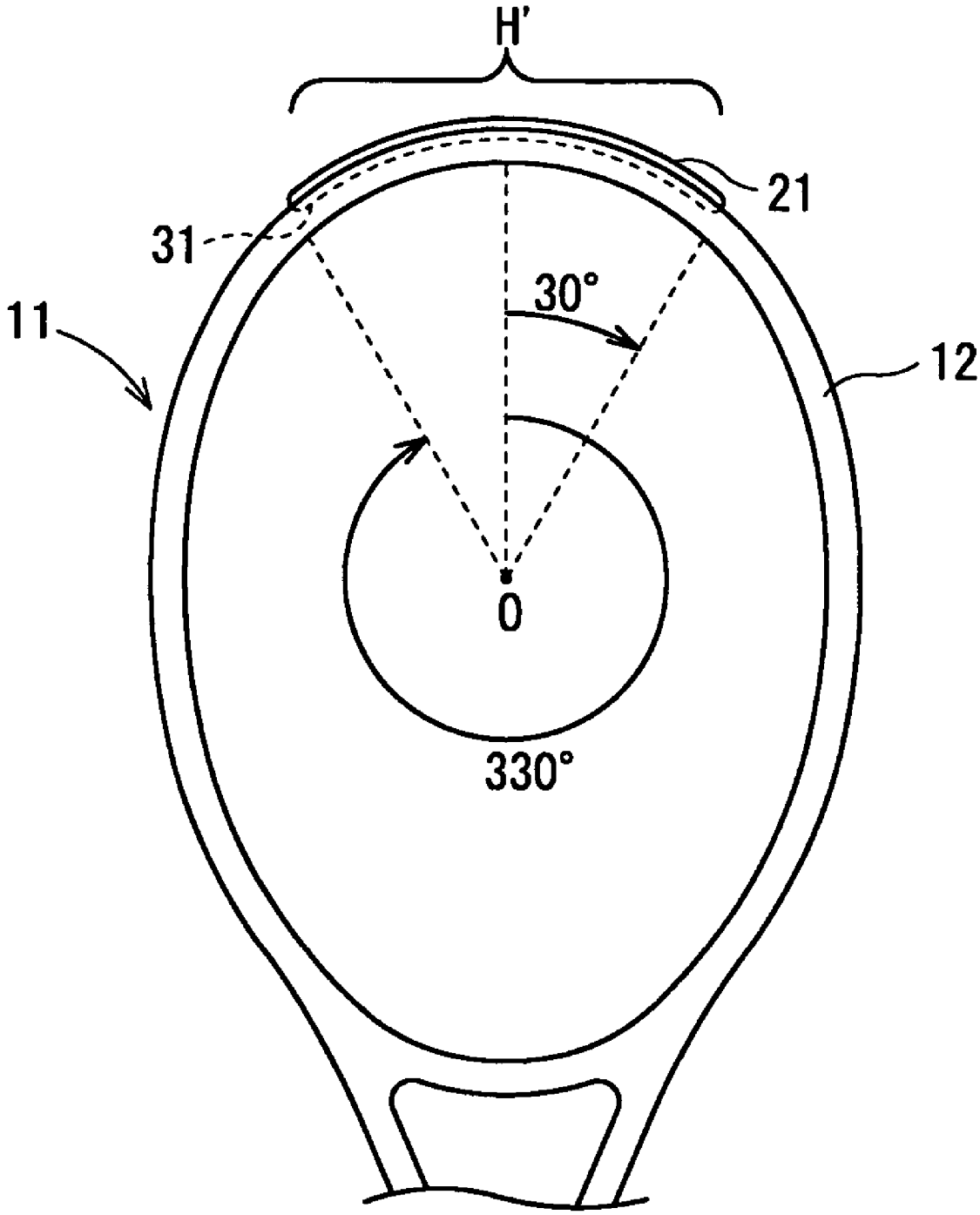
FIG. 11 is a front view showing a head part of a tennis racket of a comparison example 5.

As shown in FIG. 11, one string protection member 21 and one viscoelastic member 31 were mounted in a range H' forming 60 degrees in the range from a 330-degree position to a 30-degree position, with the center of the string protection member 21 and the viscoelastic member 31 disposed at the top position of the head part 12 of the frame 11. The viscoelastic member 31 was formed by molding the vulcanized rubber composition consisting of 100 parts by weight of styrene-butadiene rubber (SBR), 1.5 parts by weight of sulfur, and 40 parts by weight of carbon black. The viscoelastic member 31 had a thickness of 3 mm and a weight of 9 g. The complex elastic modulus of the viscoelastic member 31 measured in the above-described condition was 3.86E+08 dyn/cm$^2$. The string protection member 21 had a thickness of 1 mm and a weight of 6 g. The tennis racket had a weight of 244 g.

The moment Is of inertia of the tennis racket of the comparison example 5 in the swing direction when strings were not mounted on the racket frame was set to 500,000 g/cm$^2$. The moment Ic of inertia thereof in the center direction when strings were not mounted on the racket frame was set to 14,400 g/cm$^2$ (the ratio of the moment Is of inertia to the moment Ic of inertia: about 35).

Comparison Example 6

Figure 12:
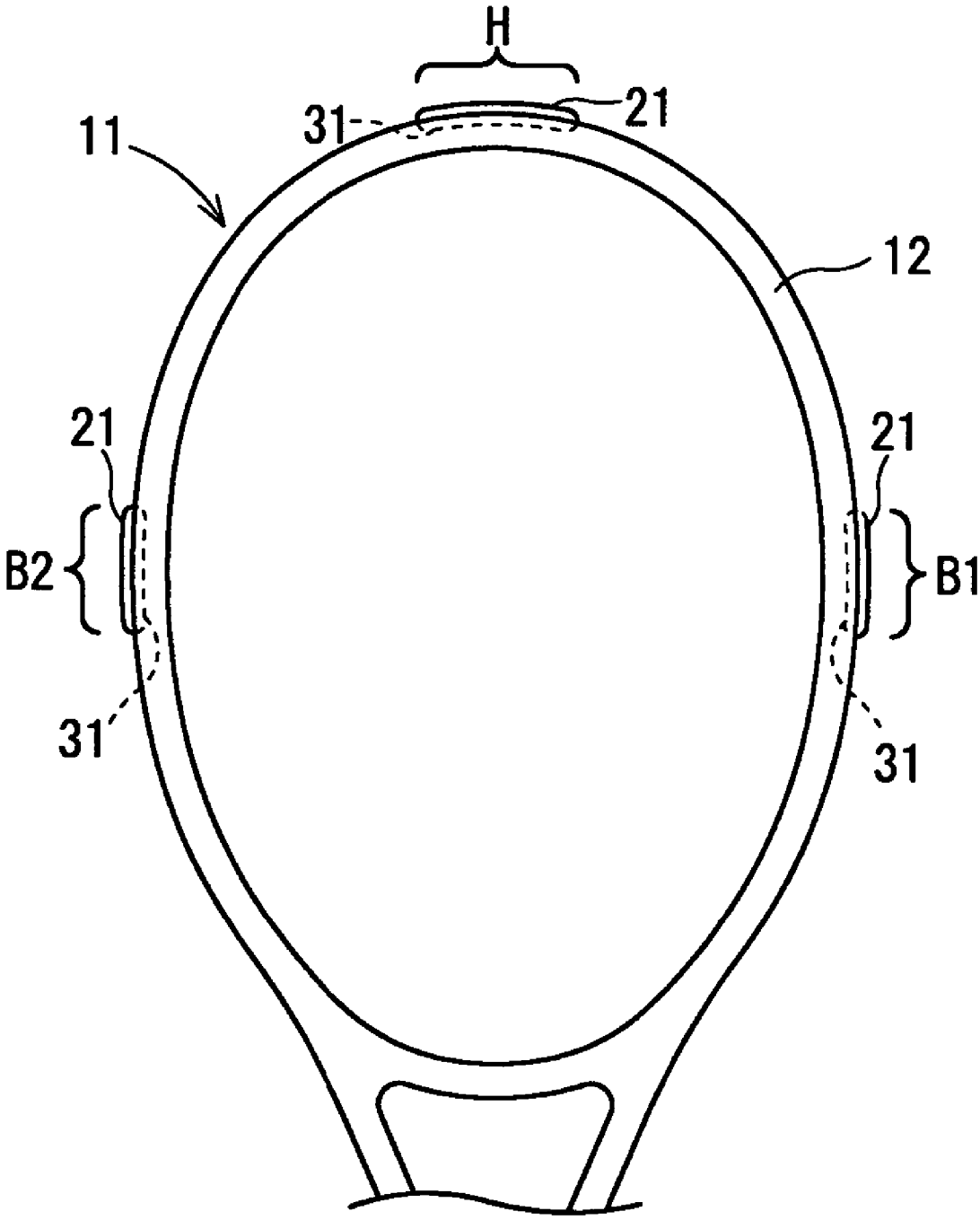
FIG. 12 is a front view showing a head part of a tennis racket of a comparison example 6.

As shown in FIG. 12, one string protection member 21 and one viscoelastic member 31 were mounted on each of the above-described range B1, the above-described range B2, and the above-described range H forming 20 degrees in the range from the 350-degree position to the 10-degree position, with the center of the string protection member 21 and the viscoelastic member 31 disposed at the top position of the head part 12 of the frame 11. The viscoelastic member 31 was formed by molding the vulcanized rubber composition consisting of 100 parts by weight of styrene-butadiene rubber (SBR), 1.5 parts by weight of sulfur, and 40 parts by weight of carbon black. The viscoelastic member 31 had a thickness of 3 mm and a weight of 3 g. The complex elastic modulus of the viscoelastic member 31 measured in the above-described condition was 3.86E+08 dyn/cm$^2$. The string protection member 21 had a thickness of 1 mm and a weight of 2 g. The tennis racket had a weight of 244 g.

The moment Is of inertia of the tennis racket of the comparison example 6 in the swing direction when strings were not mounted on the racket frame was set to 497,000 g/cm$^2$. The moment Ic of inertia thereof in the center direction when strings were not mounted on the racket frame was set to 17,900 g/cm$^2$ (the ratio of the moment Is of inertia to the moment Ic of inertia: about 28).

Comparison Example 7

Figure 13:
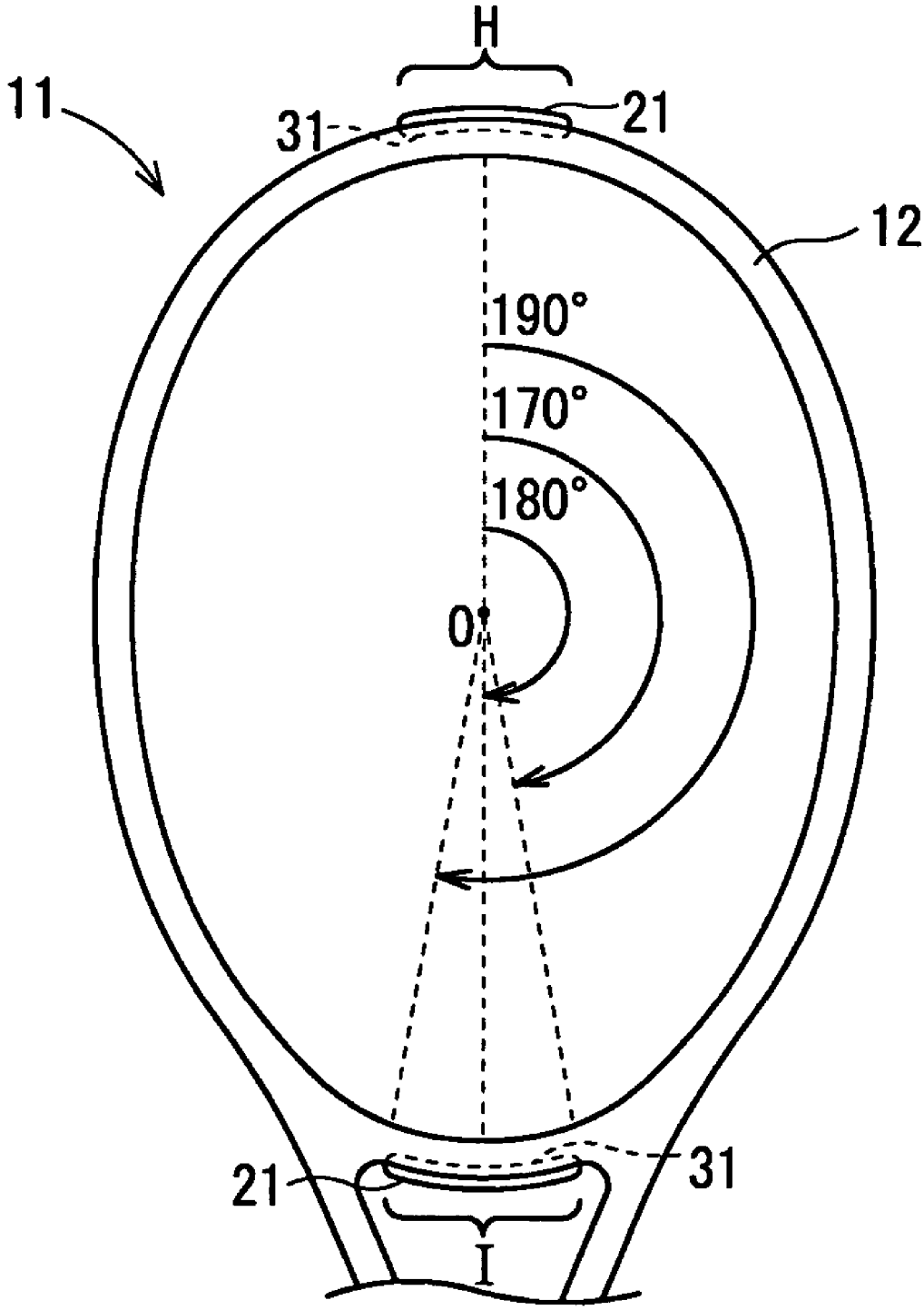
FIG. 13 is a front view showing a head part of a tennis racket of a comparison example 7.

As shown in FIG. 13, one string protection member 21 and one viscoelastic member 31 were mounted on each of the above-described range H forming 20 degrees in the range from the 350-degree position to the 10-degree position, with the center of the string protection member 21 and the viscoelastic member 31 disposed at the top position (12 o'clock position) of the head part 12 of the frame 11 and a range I forming 20 degrees in the range from a 170-degree position to a 190-degree position, with the center of the string protection member 21 and the viscoelastic member 31 disposed at the 6 o'clock position of the head part 12. The viscoelastic member 31 was formed by molding the vulcanized rubber composition consisting of 100 parts by weight of the styrene-butadiene rubber (SBR), 1.5 parts by weight of the sulfur, and 40 parts by weight of the carbon black. The viscoelastic member 31 had a thickness of 3 mm and a weight of 3 g. The complex elastic modulus of the viscoelastic member 31 measured in the above-described condition was 3.86E+08 dyn/cm$^2$. The string protection member 21 had a thickness of 1 mm and a weight of 2 g. The tennis racket had a weight of 240 g.

The moment Is of inertia of the tennis racket of the comparison example 6 in the swing direction when strings were not mounted on the racket frame was set to 470,000 g/cm$^2$. The moment Ic of inertia thereof in the center direction when strings were not mounted on the racket frame was set to 14,500 g/cm$^2$ (the ratio of the moment Is of inertia to the moment Ic of inertia: about 32).

Comparison Example 8

Figure 14:
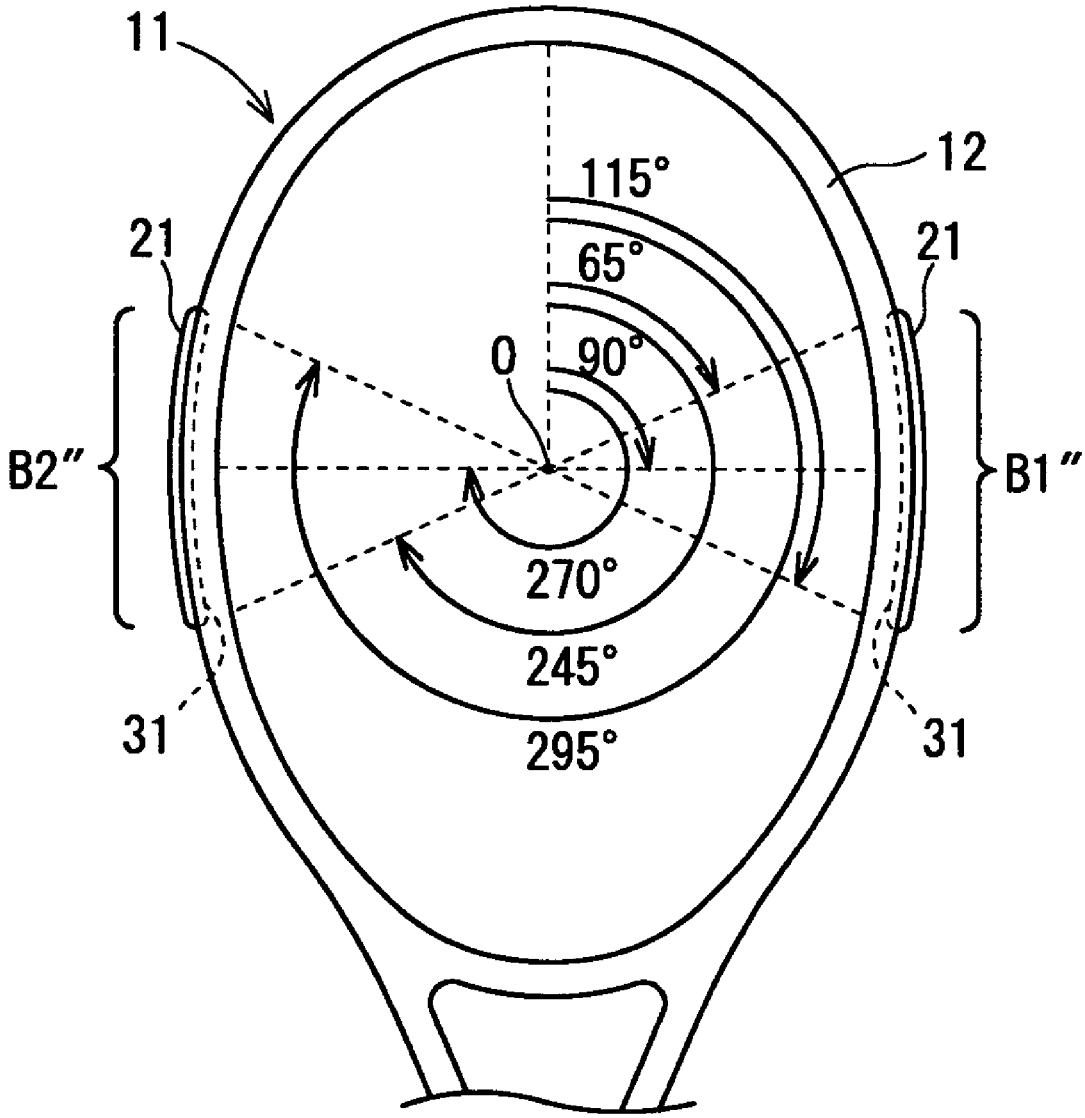
FIG. 14 is a front view showing a head part of a tennis racket of a comparison example 8.

As shown in FIG. 14, the range in which the string protection member 21 and the viscoelastic member 31 were disposed was set longer than that of the example 4. The thickness of each of the string protection member 21 and the viscoelastic member 31 was also set larger than that of the example 4. More specifically, one string protection member 21 and one viscoelastic member 31 were mounted on each of a range B1" forming 50 degrees between a 65-degree position to a 115-degree position, with the center of the string protection member 21 and the viscoelastic member 31 disposed at the 3 o'clock position of the head part 12 of the frame 11 and a range B2" forming 50 degrees in the range from a 245-degree position to a 295-degree position, with the center of the string protection member 21 and the viscoelastic member 31 disposed at the 9 o'clock position of the head part 12. The viscoelastic member 31 was formed by molding the vulcanized rubber composition consisting of 100 parts by weight of the styrene-butadiene rubber (SBR), 1.5 parts by weight of the sulfur, and 40 parts by weight of the carbon black. The viscoelastic member 31 had a thickness of 7 mm and a weight of 7 g. The complex elastic modulus of the viscoelastic member 31 measured in the above-described condition was 3.86E+08 dyn/cm$^2$. The string protection member 21 had a thickness of 2.5 mm and a weight of 5 g. The tennis racket had a weight of 253 g.

The moment Is of inertia of the tennis racket of the comparison example 8 in the swing direction when strings were not mounted on the racket frame was set to 510,000 g/cm$^2$. The moment Ic of inertia thereof in the center direction when strings were not mounted on the racket frame was set to 19,200 g/cm$^2$ (the ratio of the moment Is of inertia to the moment Ic of inertia: about 27).

Comparison Example 9

The thickness and weight of the viscoelastic member 31 of the comparison example 9 were set smaller than those of the viscoelastic member of the example 2. More specifically, one string protection member 21 and one viscoelastic member 31 were mounted on each of the above-described ranges B1 and B2. The viscoelastic member 31 was formed by molding the vulcanized rubber composition consisting of 100 parts by weight of the styrene-butadiene rubber (SBR), 1.5 parts by weight of the sulfur, and 40 parts by weight of the carbon black. The viscoelastic member 31 had a thickness of 1 mm and a weight of 1 g. The complex elastic modulus of the viscoelastic member 31 measured in the above-described condition was 3.86E+08 dyn/cm$^2$. The string protection member 21 had a thickness of 1 mm and a weight of 2 g. The tennis racket had a weight of 235 g.

The moment Is of inertia of the tennis racket of the comparison example 6 in the swing direction when strings were not mounted on the racket frame was set to 443,000 g/cm$^2$. The moment Ic of inertia thereof in the center direction when strings were not mounted on the racket frame was set to 16,400 g/cm$^2$ (the ratio of the moment Is of inertia to the moment Ic of inertia: about 27).

Measurement of Moment of Inertia

Figure 16A:
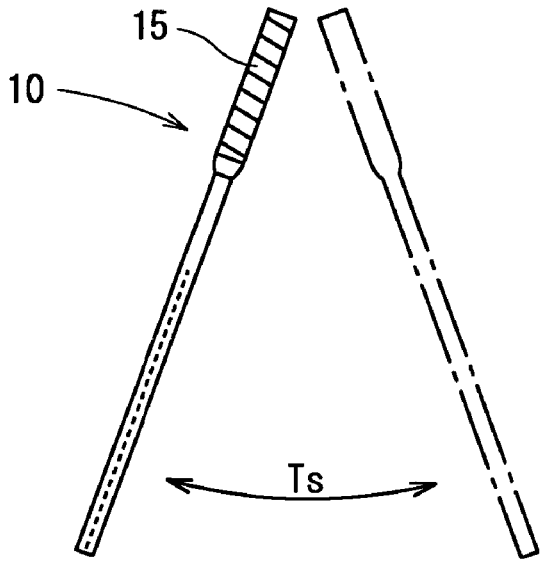
FIGS. 16A and 16B are schematic views showing a method of measuring the moment of inertia of a racket frame.

As shown in FIG. 16(A), each tennis racket 10 was hung with an instrument for measuring the moment of inertia thereof, with the grip 15 thereof located uppermost to measure a swing period Ts thereof. The moment of inertia thereof in the swing direction (moment of inertia in out-of-plane direction on grip end) was computed by the following equations.

Figure 16B:
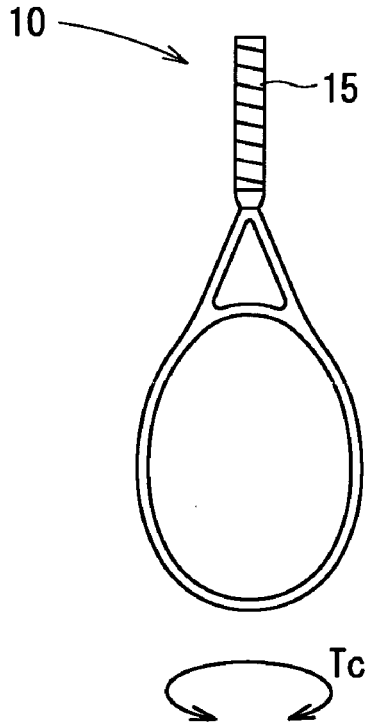

As shown in FIG. 16(B), each tennis racket was hung with the instrument for measuring the moment of inertia thereof, with the grip 15 thereof located uppermost to measure the center period Ts thereof. The moment of inertia thereof in the center direction (moment of inertia on axis of grip) was computed by the following equations.

Calculation of Moment of Inertia

Swing direction: Is (g·cm$^2$)

$$Is = M \times g \times h(Ts/2/\pi)^2 - Ic$$

Center direction: Ic (g·cm$^2$)

$$Ic = 254458 \times (Tc/\pi)^2 - 8357$$

Around center of gravity: Ig $$Ig = Is - m(l+2.6)^2$$

Where M=m+mc, h=(m×l−mc×lc)/m+2.6, mc: weight of tennis racket, l: balance point of tennis racket, mc: weight of chuck, lc: balance point of chuck.

Measurement of Coefficient of Restitution

Figure 17:
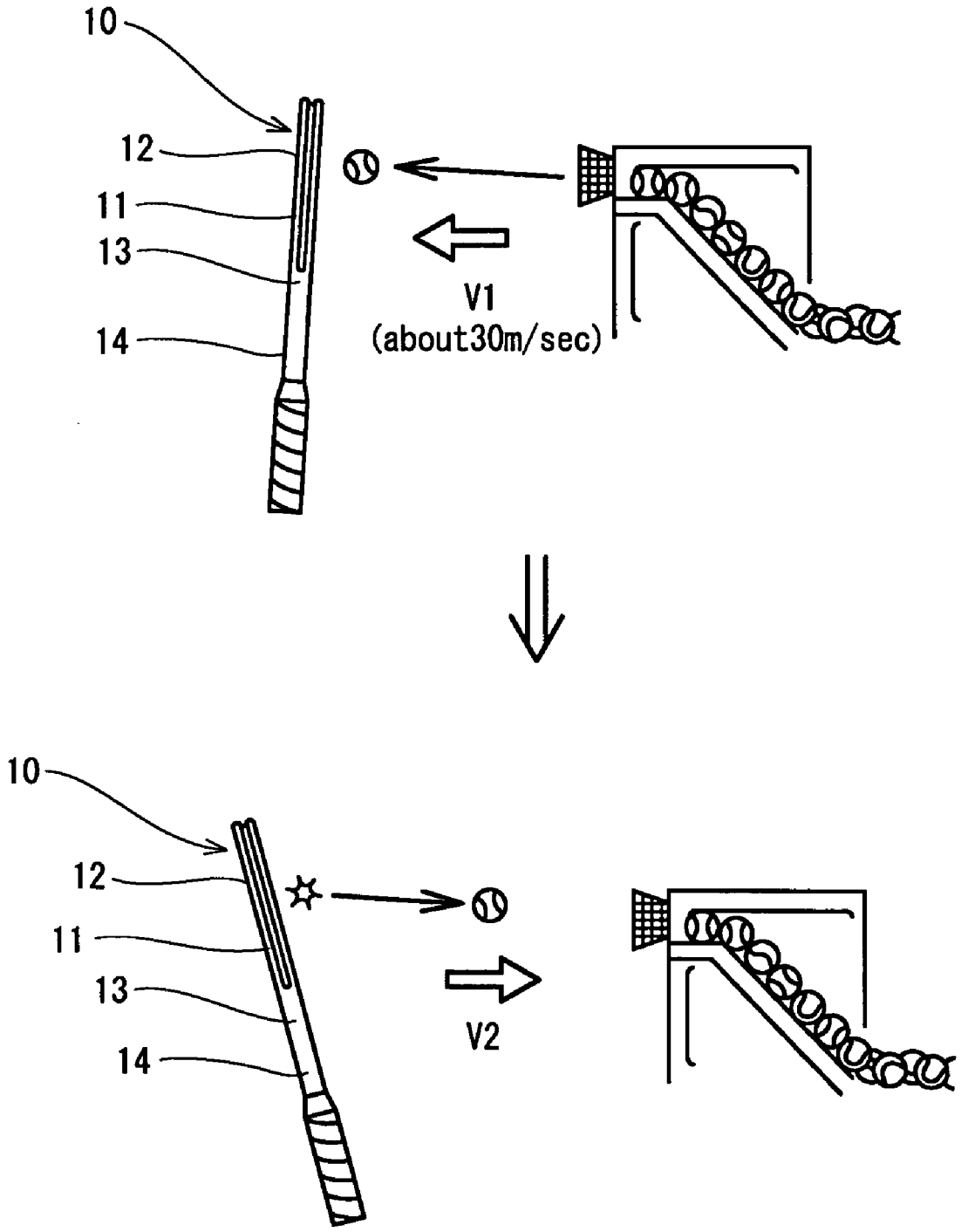
FIG. 17 is a schematic view showing a method of measuring the rebound performance of a racket frame.

As shown in FIG. 17, strings were tensionally mounted on a tennis racket 10 of each of the examples and the comparison examples at a tensile force of 60 pounds applied thereto longitudinally and 55 pounds applied thereto widthwise. The grip part 15 was fixed at a weak force to allow the tennis racket 10 to be free, with the tennis racket set vertically. A tennis ball driven by a ball-launching machine collided with the ball-hitting face of the tennis racket at a constant speed V1 (30 m/sec) to measure a speed V2 of the rebound tennis ball. The coefficient of restitution is obtained by computing the ratio of the launched speed V1 to the rebounded speed V2. The higher the coefficient of restitution is, the longer the tennis ball was rebounded.

Measurement of Primary Out-of-Plane Vibration-Damping Factor

Figure 18A:
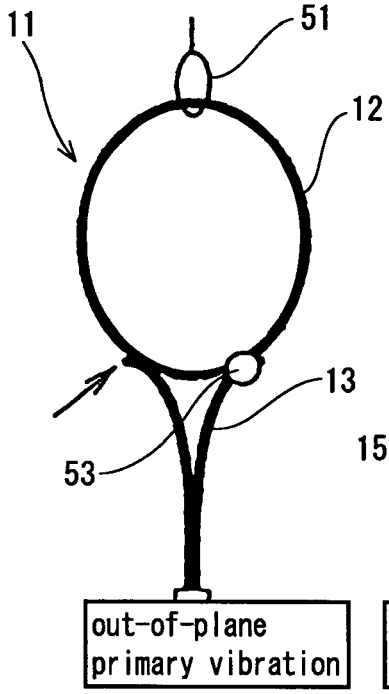
FIGS. 18A, 18B, and 18C are schematic views showing a method of measuring the vibration-damping factor of a racket frame.

As shown in FIG. 18A, the upper end of the head part 12 of the racket frame 11 of each of the examples and the comparison examples was hung with a string 51. An acceleration pick-up meter 53 was fixed vertically to the ball-hitting face at one connection point between the head part 12 and the throat part 13. In this state, as shown in FIG. 18B, the other connection point between the head part 12 and the throat part 13 was hit with an impact hammer 55 to impart vibration to the racket frame 11. An input vibration (F) measured with a force pick-up meter installed on the impact hammer 55 and a response vibration ($\alpha$) measured with the acceleration pick-up meter 53 were inputted to a frequency analyzer 57 (manufactured by Hewlett Packard Corp., dynamic single analyzer HP 3562A) through amplifiers 56A and 56B to analyze the input vibration (F) and the response vibration ($\alpha$). A transmission function in a frequency region obtained by the analysis was determined to obtain the frequency of the tennis racket. The vibration-damping ratio ($\zeta$) was computed by using the following equation to obtain the primary out-of-plane vibration-damping factor. Table 1 shows the average value of the primary out-of-plane vibration-damping factor of the racket frame of each of the examples and the comparison examples.

$$\zeta=(1/2)\times(\Delta\omega/\omega n)$$

$$To=Tn\times\sqrt{2}$$

Measurement of Secondary Out-of-Plane Vibration-Damping Factor

Figure 18C:
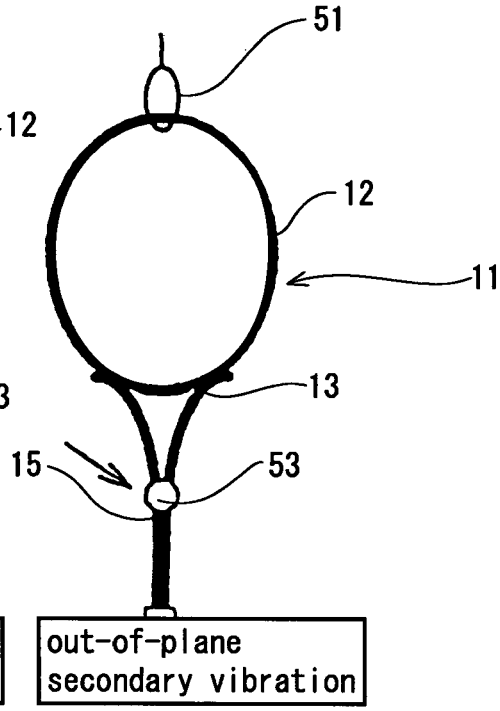
Figure 18B:
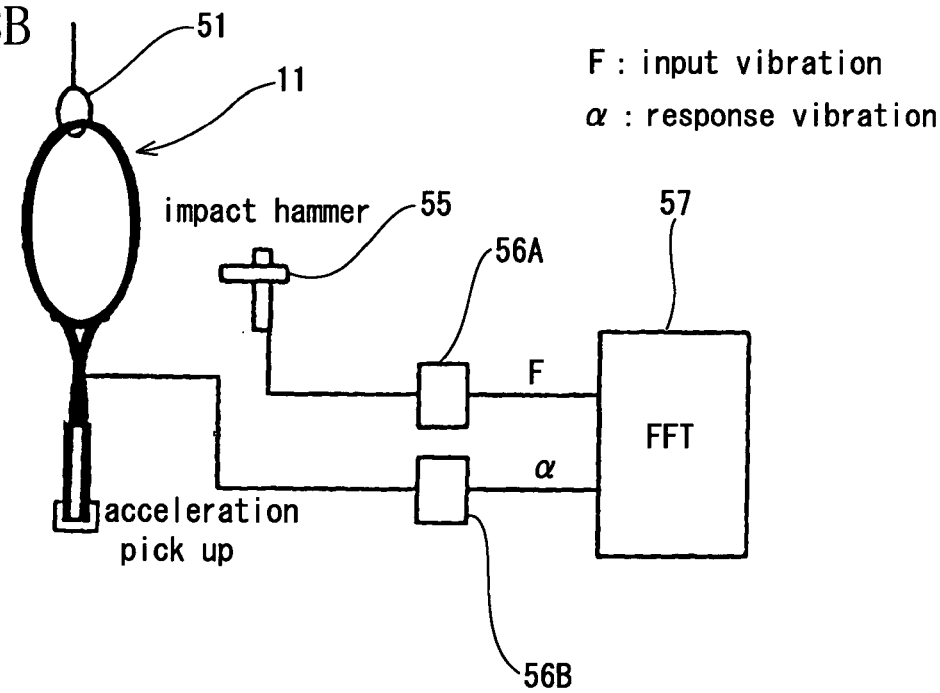
Figure 19:
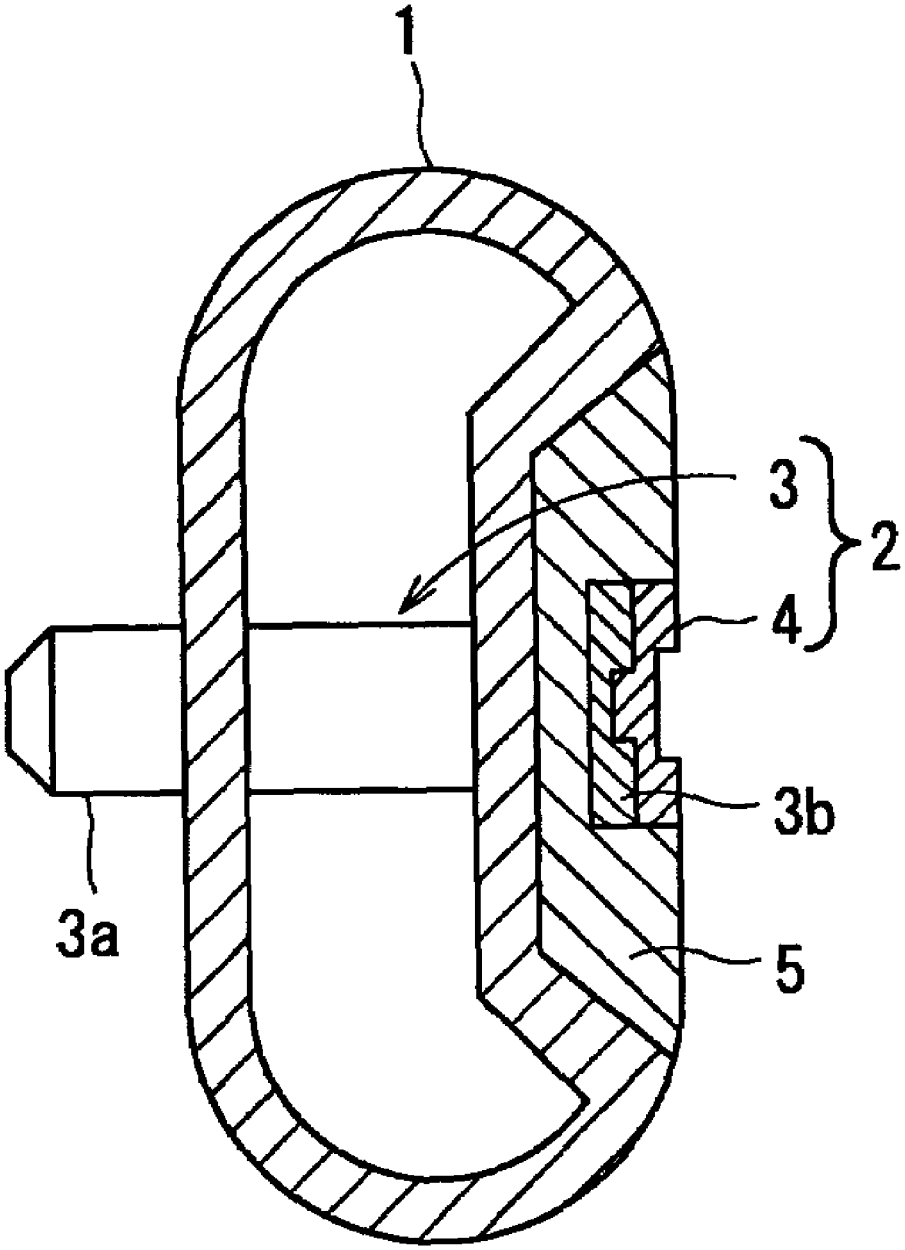
FIG. 19 is a sectional view showing a conventional tennis racket.

As shown in FIG. 18C, the upper end of the head part 12 of the racket frame 11 of each of the examples and the comparison examples was hung with the string 51. The acceleration pick-up meter 53 was fixed vertically to the ball-hitting face at one connection point between the head part 12 and the throat part 13. In this state, to vibrate the racket frame 11, the rear surface of the racket frame 11 was hit with the impact hammer 55 at the portion of the rear surface thereof opposite to the portion of the front surface thereof where the acceleration pick-up meter 53 was mounted. The vibration-damping factor was computed by a method equivalent to that used in computing the primary out-of-plane vibration-damping factor to obtain the secondary out-of-plane vibration-damping factor. Table 1 shows the average value of the secondary out-of-plane vibration-damping factor of the racket frame 11 of each of the examples and the comparison examples.

Evaluation of Tennis Racket by Hitting Ball

To examine the operability, face stability (controllability), rebound performance, and vibration-absorbing performance of each tennis racket, a questionnaire was conducted by requesting testers to hit tennis balls therewith. The questionnaire paper was marked on the basis of five (the more, the better). The operability, face stability (controllability), rebound performance, and vibration-absorbing performance of each tennis racket were evaluated on the basis of the average of marks given by 33 middle and high class players (who satisfied the condition that testers have more than 10 years' experience of tennis and play tennis three or more days a week).

The frame of the comparison example 1 was more lightweight by about 15 g/5 mm than the conventional frame. As can be confirmed in table 1, the moment of inertia of the frame of the comparison example 1 was small in both the swing direction and the center direction. It was confirmed that the tennis racket of the comparison example 1 had a favorable operability, but had unfavorable ball-flying (ball rebound) performance, face stability and vibration-absorbing performance. In the tennis racket of the comparison example 2, the weight having five grams was mounted on the 3 o'clock position and the 9 o'clock position of the frame. The tennis racket of the comparison example 2 had a larger moment of inertia than that of the comparison example 1. Therefore the tennis racket of the comparison example 2 had improved rebound performance and face stability but had unfavorable vibration-absorbing performance. In the tennis racket of the comparison example 3, to increase the moment of inertia in the center direction and decrease the moment of inertia in the swing direction, the weight of the frame of the comparison example 3 was reduced by 14 g. The weight having 12 g was mounted on the 3 o'clock position (90-degree position) and the 9 o'clock position (270-degree position) of the frame. The tennis racket of the comparison example 3 had favorable operability and face stability but its ball-flying performance was equal to that of the tennis racket of the comparison example 2.

The position and length of the string protection member and the material and thickness of the viscoelastic member were examined.

Comparison is made between the tennis racket of the comparison example 2 having no viscoelastic member mounted thereon and the tennis racket of the example 2 having the viscoelastic member mounted thereon. The moment of inertia of the tennis racket of the comparison example 2 was equal to that of the tennis racket of the example 2. But the former had much improvement over the latter in the coefficient of restitution and vibration-absorbing performance thereof. This is attributed to the fact that the viscoelastic member was mounted on the 3 o'clock position (90-degree position) and the 9 o'clock position (270-degree position) of the frame of the former, which improved the secondary out-of-plane vibration-damping factor thereof. It has been found that the viscoelastic member mounted on the above-described positions improves not only the vibration-absorbing performance of the racket frame but also its rebound performance.

Comparison is made between the tennis rackets of the comparison examples 4 through 7 and the tennis rackets of the examples 1 through 3, 5, and 6. In the tennis racket of each of the examples 1 through 3, 5, and 6 and the comparison example 6, the viscoelastic member was mounted on at least one portion of the head part in the range from the 45-degree position to the 135-degree position and in the range from the 225-degree position to the 315-degree position. The tennis racket of each of the examples 1 through 3, 5, and 6 and the comparison example 6 had a high coefficient of restitution. The rebound performance, face stability, operability, and vibration-absorbing performance of the tennis racket of each of the examples 1 through 3, 5, and 6 were rated highly. In the tennis racket of each of the comparison examples 4, 5, and 7, neither the string protection member nor the viscoelastic member was disposed in the above-described range of the head part of the frame. Thus the moment of inertia of the tennis racket each of the comparison examples 4, 5, and 7 in the swing direction was more than 490,000 g/cm$^2$, and the moment (Ic) of inertia thereof in the center direction was less than 15,000 g/cm$^2$. Thus the ball-flying performance and face stability of the tennis racket of each of the comparison examples 4, 5, and 7 were rated low.

Comparison is made between the tennis racket of the example 2, the example 4, and the comparison example 8 is made. The string protection members of these tennis rackets were different in the length (angle) thereof. The tennis racket of the comparison example 8 having the 60-degree range in which the string protection member was disposed was rated more highly than the tennis racket of the example 4 having the 40-degree range in which the string protection member was disposed. The tennis racket of the example 4 having the 40-degree range in which the string protection member was disposed was rated more highly than the tennis racket of the example 2 having the 20-degree range in which the string protection member was disposed. The moment of inertia of the tennis racket each of the comparison example 8 in the swing direction was more than 490,000 g/cm$^2$, and the moment of inertia thereof in the center direction was more than 19,000 g/cm$^2$. Thus the operability of the tennis racket of the comparison example 8 was rated low.

The moment of inertia of the tennis racket of each of the examples 1 through 11 in the swing direction was not less than 450,000 g/cm$^2$ nor more than 490,000 g/cm$^2$. The moment of inertia thereof in the center direction was not less than 15,000 g/cm$^2$ nor more than 19,000 g/cm$^2$. Thus these tennis rackets were rated highly in the ball-flying performance, face stability, and operability. On the other hand, the moment of inertia of the tennis racket of each of the comparison examples 1 through 9 was out of the above-described range in the swing direction and in the center direction. Thus the tennis racket of each of the comparison examples 1 through 9 was rated low in the operability, rebound performance or face stability thereof or low in all of the operability, ball-flying performance, and face stability thereof.

Comparison is made between the tennis racket of the example 2 and the tennis racket (thickness of viscoelastic member: 7 mm) of the comparison example 8 and the tennis racket (thickness of viscoelastic member: 1 mm) of the comparison example 9. It has been found that the tennis racket of the example 2 in which the thickness of the viscoelastic member was not less than 1 mm nor more than 5 mm was superior to the tennis racket of the comparison examples 8 and 9 in the operability, ball-flying performance, face stability, and vibration-absorbing performance.

Comparison is made between the tennis racket of the example 2 and the tennis racket of the examples 7 through 10 in terms of the material of the viscoelastic member. The complex elastic modulus of the viscoelastic member used for the tennis racket of the examples 2, 8, and 9 measured at the frequency of 10 Hz was not less than 2.0E+7 dyn/cm$^2$ nor more than 1.0E+10 dyn/cm$^2$ at temperatures in the range of 0° C. to 10° C. Therefore the tennis racket of the examples 2, 8, and 9 had high vibration-absorbing performance.

Figure 15A:
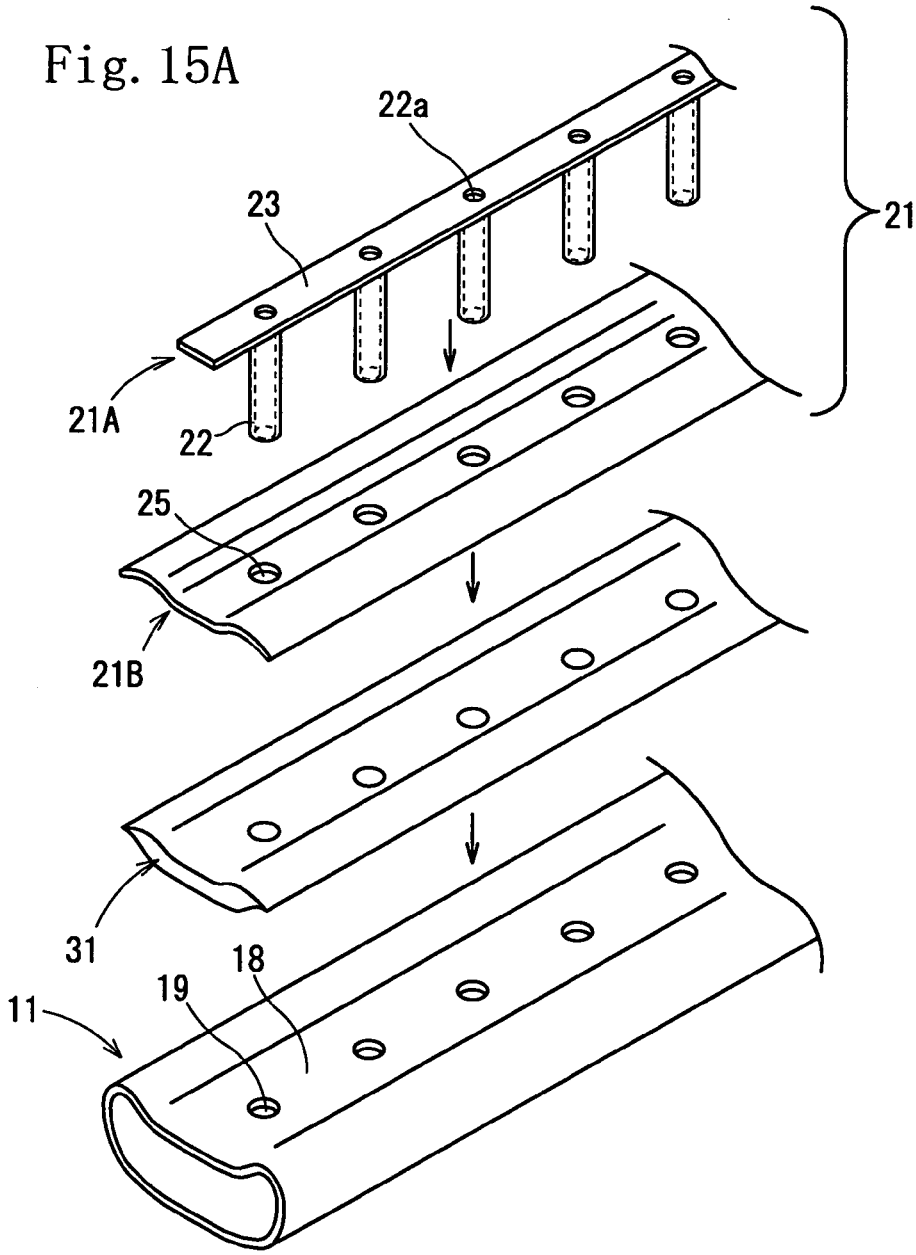
FIG. 15A is an exploded perspective view showing a string protection member according to another embodiment of the present invention.
Figure 15B:
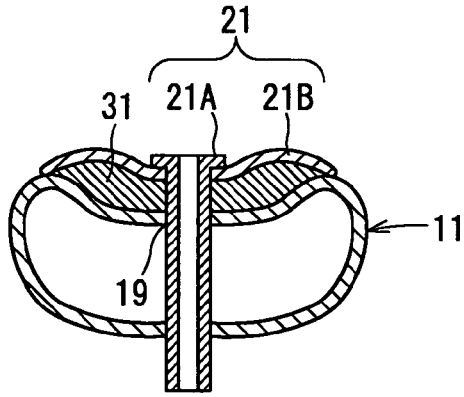
FIG. 15B is a sectional view showing a state in which the string protection member shown in FIG. 15A and the viscoelastic member are mounted on a racket frame.

The present invention is not limited to the above-described embodiments or examples. For example, as shown in FIGS. 15A and 15B, the string protection member 21 may be constructed of a grommet part 21A composed of the cylindrical portion 22 and the narrow belt-shaped portion 23 and a wide plate-shaped part 21B, made of FRP, separate from the grommet part 21A. A plurality of through-holes 25 through which the cylindrical portions 22 are inserted respectively is formed in penetration through the plate-shaped part 21B.

What is claimed is:

1. A tennis racket comprising a racket frame having a weight of not less than 100 g nor more than 270 g.

a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame; said viscoelastic member having a plurality of holes through which said cylindrical portions of said string protection member are penetrated; and is plate-shaped so that said viscoelastic member is interposed between said belt-shaped portion and a peripheral surface of said head part, and the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

2. The tennis racket according to claim 1, wherein an angular difference between a start angular position of said string protection member and a termination angular position thereof is set to not less than 10 degrees nor more than 60 degrees.

3. The tennis racket according to claim 1, wherein the width of said belt-shaped portion of said string protection member is large so that said string protection member has a configuration which covers both outer surfaces of said head part between which a string groove thereof is interposed; and said string protection member is mounted on said head part by interposing said viscoelastic member between said belt-shaped portion said string protection member and said head part, with said viscoelastic member covering the entire lower surface of said belt-shaped portion.

4. The tennis racket according to claim 1, wherein a bumper made of fiber reinforced resin is interposed between said string protection member and said viscoelastic member.

5. A tennis racket comprising a racket frame having a weight of not less than 1000 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

said viscoelastic member having a thickness of not less than 1mm nor more than 5mm, and a complex elastic modulus measured at a frequency of 10 Hz of not less than 2.0E 7 dyn/cm$^2$ nor more than 1.0E +10 dyn/cm$^2$, at a temperature in a range of 0° C. to 10° C.; said viscoelastic member has a plurality of holes through which said cylindrical portions of said string protection member are penetrated; and is plate-shaped so that said viscoelastic member is interposed between said belt-shaped portion and a peripheral surface of said head part, and the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

6. The tennis racket according to claim 5, wherein an angular difference between a start angular position of said string protection member and a termination angular position thereof is set to not less than 10 degrees nor more than 60 degrees.

7. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame; and a bumper made of fiber reinforced resin interposed between said string protection member and said viscoelastic member, wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

8. The tennis racket according to claim 7, wherein said viscoelastic member has a thickness of not less than 1mm nor more than 5mm, and a complex elastic modulus measured at a frequency of 10 Hz of not less than 2.0E+7 dyn/cm$^2$ nor more than 1.0E+10 dyn/cm$^2$, at a temperature in a range of 0° C. to 10° C.

9. The tennis racket according to claim 7, wherein an angular difference between a start angular position of said string protection member and a termination angular position thereof is set to not less than 10 degrees nor more than 60 degrees.

10. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

said viscoelastic member having a thickness of not less than 1mm nor more than 5mm, and a complex elastic modulus measured at a frequency of 10 Hz of not less than 2.0E+7 dyn/cm$^2$ nor more than 1.0E+10 dyn/cm$^2$, at a temperature in a range of 0° C. to 10° C., and a bumper made of fiber reinforced resin interposed between said string protection member and said viscoelastic member, wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

11. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

and a bumper made of a fiber reinforced resin interposed between said string protection member and said viscoelastic member;

wherein an angular difference between a start angular position of said string protection member and a termination angular position thereof is set to not less than 10 degrees nor more than 60 degrees; and wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

12. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

said viscoelastic member having a thickness of not less than 1 mm nor more than 5 mm, and a complex elastic modulus measured at a frequency of 10 Hz of not less than 2.0E+7 dyn/cm$^2$ nor more than 1.0E+10 dyn/cm$^2$, at a temperature in a range of 0° C. to 10° C.; and wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

13. A tennis racket comprising a racket frame having a weight of not less than 100 g nor more than 270 g.

a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

said viscoelastic member having a plurality of holes through which said cylindrical portions of said string protection member are penetrated; and is plate-shaped so that said viscoelastic member is interposed between said belt-shaped portion and a peripheral surface of said head part; and a bumper made of fiber reinforced resin interposed between said string protection member and said viscoelastic member;

wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

14. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein the width of said belt-shaped portion of said string protection member is large so that said string protection member has a configuration which covers both outer surfaces of said head part between which a string groove thereof is interposed; and said string protection member is mounted on said head part by interposing said viscoelastic member between said belt-shaped portion, said string protection member and said head part, with said viscoelastic member covering the entire lower surface of said belt-shaped portion wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame; the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

15. The tennis racket according to claim 14, wherein an angular difference between a start angular position of said string protection member and a termination angular position thereof is set to not less than 10 degrees nor more than 60 degrees.

16. The tennis racket according to claim 14, wherein said viscoelastic member has thickness of not less than 1mm nor more than 5mm, and a complex elastic modulus measured at a frequency of 10 Hz of not less than 2.0E+7 dyn/cm$^2$ nor more than 1.0E+10 dyn/cm$^2$, at a temperature in a range of 0° C. to 10° C.

17. The tennis racket according to claim 14, wherein an angular difference between a start angular position of said string protection member and a termination angular position thereof is set to not less than 10 degrees nor more than 60 degrees.

18. A tennis racket comprising a racket frame having a weight of not less than 100 g nor more than 270 g, a string protection member provided on at least one portion of a peripheral surface of a head part surrounding a ball-hitting face of said racket frame, said string protection member having a belt shaped portion and constructed integral with a plurality of cylindrical portions through which strings are respectively inserted wherein the width of said belt-shaped portion of said string protection member is large so that said string protection member has a configuration which covers both outer surfaces of said head part between which a string groove thereof is interposed; and said string protection member is mounted on said head part by interposing said viscoelastic member between said belt-shaped portion, said string protection member and said head part, with said viscoelastic member covering the entire lower surface of said belt-shaped portion wherein, if a midpoint of a maximum length of said ball-hitting face of said racket frame is set as a center thereof and that an intersection of a longest line of said ball-hitting face and an upper part of said ball-hitting face is set as a 0-degree position, a viscoelastic member is mounted on at least one portion of said head part in a range of from a 45-degree position to a 135-degree position and in a range from a 225-degree position to a 315-degree position by interposing said viscoelastic member between said string protection member and said racket frame;

said viscoelastic member having a thickness of not less than 1mm nor more than 5mm, and a complex elastic modulus measured at a frequency of 10 Hz of not less than 2.E 7dyn/cm$^2$ nor more than 1.0E+10dyn/cm$^2$, at a temperature in a range of 0° C. to 10° C.; and wherein the moment (Is) of inertia of said tennis racket in a swing direction is set to be not less than 450,000 g/cm$^2$ nor more than 490,000 g/cm$^2$, when said strings are not tensionally mounted thereon; and the moment (Ic) of inertia of said tennis racket in a center direction is set to be not less than 15,000 g/cm$^2$ nor more than 19,000 g/cm$^2$, when said strings are not tensionally mounted thereon.

* * * * *